US009812065B2

(12) United States Patent
Ryu et al.

(10) Patent No.: US 9,812,065 B2
(45) Date of Patent: Nov. 7, 2017

(54) DATA DRIVER, ORGANIC LIGHT EMITTING DISPLAY DEVICE USING THE SAME, AND METHOD OF DRIVING THE ORGANIC LIGHT EMITTING DISPLAY DEVICE

(71) Applicants: SAMSUNG DISPLAY CO., LTD., Yongin, Gyeonggi-do (KR); IUCF-HYU (Industry-University Cooperation Foundation Hanyang University), Seongdong-gu, Seoul (KR)

(72) Inventors: Do Hyung Ryu, Yongin (KR); Bo Yong Chung, Yongin (KR); Hong Kwon Kim, Yongin (KR); Oh Kyong Kwon, Yongin (KR)

(73) Assignees: Samsung Display Co., Ltd., Yongin-si (KR); Industry-University Cooperation Foundation Hanyang University, Seoul (KR)

( * ) Notice: Subject to any disclaimer, the term of this patent is extended or adjusted under 35 U.S.C. 154(b) by 513 days.

(21) Appl. No.: 14/150,614

(22) Filed: Jan. 8, 2014

(65) Prior Publication Data

US 2014/0125713 A1 May 8, 2014

Related U.S. Application Data

(62) Division of application No. 11/501,245, filed on Aug. 7, 2006, now Pat. No. 8,659,511.

(30) Foreign Application Priority Data

Aug. 10, 2005 (KR) ..... 10-2005-0073047
Aug. 10, 2005 (KR) ..... 10-2005-0073048

(51) Int. Cl.
*G09G 5/10* (2006.01)
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/0819* (2013.01);
(Continued)

(58) Field of Classification Search
CPC ..... G09G 3/3291; G09G 3/3233; G09G 2300/0819; G09G 2310/0251;
(Continued)

(56) References Cited

U.S. PATENT DOCUMENTS 5,952,789 A 9/1999 Stewart et al.
6,168,532 B1 1/2001 McCaffrey
(Continued)

FOREIGN PATENT DOCUMENTS

CN 1637799 A 7/2005
CN 1581253 B 7/2012
(Continued)

OTHER PUBLICATIONS

In HJ, Bae JH, Kang JS, Kwon OK, Chung HK. A Novel Voltage-Programming Pixel with Current-Correction Method for Large-Size and High-Resolution AMOLEDs on Poly-Si Backplane. InInternational Meeting on Information Display, IMID Jul. 23, 2005 (vol. 5, pp. 901-904).*
(Continued)

*Primary Examiner* — Patrick Edouard
*Assistant Examiner* — Joseph Fox
(74) *Attorney, Agent, or Firm* — Lewis Roca Rothgerber Christie LLP

(57) ABSTRACT

A data driver capable of displaying images with a substantially uniform brightness, an organic light emitting display
(Continued)

device using the same, and a method of driving the organic light emitting display device. The data driver includes a plurality of current sink units for controlling predetermined currents to flow through data lines, a plurality of voltage generators for resetting values of gray scale voltages using compensation voltages generated when the predetermined currents flow, a plurality of digital-to-analog converters for selecting one gray scale voltage among the gray scale voltages as a data signal in response to bit values of the data supplied from the outside, and a plurality of switching units for supplying the data signal to the data lines. The predetermined currents may be set equal to pixel currents that correspond to a maximum brightness.

12 Claims, 13 Drawing Sheets

(52) U.S. Cl.
CPC ..... *G09G 2300/0852* (2013.01); *G09G 2300/0861* (2013.01); *G09G 2310/0251* (2013.01); *G09G 2320/0276* (2013.01); *G09G 2320/043* (2013.01); *G09G 2352/00* (2013.01)

(58) Field of Classification Search
CPC ..... G09G 2352/00; G09G 2300/0852; G09G 2320/0276; G09G 2320/043; G09G 2300/0861
See application file for complete search history.

(56) References Cited

U.S. PATENT DOCUMENTS

| | | | | |
|---|---|---|---|---|
| 6,169,532 | B1 * | 1/2001 | Sumi | G09G 3/3233 345/212 |
| 6,177,767 | B1 | 1/2001 | Asai et al. | |
| 6,404,139 | B1 | 6/2002 | Sasaki et al. | |
| 6,859,193 | B1 | 2/2005 | Yumoto | |
| 7,911,427 | B2 * | 3/2011 | Chung | G09G 3/3233 315/169.3 |
| 8,593,378 | B2 * | 11/2013 | Ryu | G09G 3/3233 315/169.3 |
| 2002/0101395 | A1 | 8/2002 | Inukai | |
| 2003/0011314 | A1 | 1/2003 | Numao | |
| 2003/0043131 | A1 | 3/2003 | Iguchi | |
| 2003/0122813 | A1 | 7/2003 | Ishizuki et al. | |
| 2004/0095297 | A1 * | 5/2004 | Libsch | G09G 3/325 345/76 |
| 2004/0100430 | A1 | 5/2004 | Fruehauf | |
| 2004/0124780 | A1 | 7/2004 | Ha et al. | |
| 2004/0130545 | A1 | 7/2004 | Ishizuka | |
| 2004/0160168 | A1 | 8/2004 | Lee et al. | |
| 2004/0178407 | A1 * | 9/2004 | Lin | G09G 3/325 257/40 |
| 2004/0183752 | A1 | 9/2004 | Kawasaki et al. | |
| 2004/0227749 | A1 * | 11/2004 | Kimura | G09G 3/3233 345/211 |
| 2004/0239596 | A1 | 12/2004 | Ono et al. | |
| 2005/0024303 | A1 | 2/2005 | Kimura et al. | |
| 2005/0104820 | A1 | 5/2005 | Komiya | |
| 2005/0146281 | A1 | 7/2005 | Ricky Ng et al. | |
| 2005/0168416 | A1 * | 8/2005 | Hashimoto | G09G 3/3233 345/76 |
| 2007/0200812 | A1 | 8/2007 | Maede et al. | |
| 2007/0210996 | A1 * | 9/2007 | Mizukoshi | G09G 3/3233 345/77 |
| 2014/0084932 | A1 | 3/2014 | Chaji et al. | |

FOREIGN PATENT DOCUMENTS

| | | | |
|---|---|---|---|
| EP | 1 750 246 | A2 | 2/2007 |
| EP | 1 758 084 | A2 | 2/2007 |
| EP | 1 758 084 | A3 | 8/2007 |
| EP | 1 750 246 | A3 | 10/2007 |
| JP | 9-115673 | A | 5/1997 |
| JP | 10-319908 | A | 12/1998 |
| JP | 2000-056730 | A | 2/2000 |
| JP | 2000-122608 | A | 4/2000 |
| JP | 2001-22323 | A | 1/2001 |
| JP | 2002-278513 | A | 9/2002 |
| JP | 2002-304156 | A | 10/2002 |
| JP | 2002-341825 | A | 11/2002 |
| JP | 2003-76327 | A | 3/2003 |
| JP | 2003-140613 | A | 5/2003 |
| JP | 2003-202837 | A | 7/2003 |
| JP | 2003-255901 | A | 9/2003 |
| JP | 2004-004675 | A | 1/2004 |
| JP | 2004-125852 | A | 4/2004 |
| JP | 2004-151501 | A | 5/2004 |
| JP | 2004-192000 | A | 7/2004 |
| JP | 2004-219623 | A | 8/2004 |
| JP | 2004-246322 | A | 9/2004 |
| JP | 2004-287345 | A | 10/2004 |
| JP | 2004-295081 | A | 10/2004 |
| JP | 2005-148679 | A | 6/2005 |
| JP | 2007-041506 | | 2/2007 |
| JP | 2007-041515 | | 2/2007 |
| JP | 2007-041523 | | 2/2007 |
| JP | 2007-041531 | | 2/2007 |
| JP | 2007-041532 | | 2/2007 |
| JP | 2007-041586 | | 2/2007 |
| JP | 2008-523448 | A | 7/2008 |
| WO | WO 98/40871 | A1 | 9/1998 |
| WO | WO 01/06484 | A1 | 1/2001 |
| WO | WO 03/107313 | A2 | 12/2003 |
| WO | WO 2005/015530 | A1 | 2/2005 |
| WO | WO 2005/022498 | A2 | 3/2005 |

OTHER PUBLICATIONS

European Search Report dated Dec. 18, 2006, for 06118729.0, in the name of Samsung SDI Co., Ltd.
Examination Reported dated Apr. 24, 2008 for corresponding European Patent Application No. 06 118 729.0, indicating relevance of EP 1750246A2 and EP 1758084A2.
In, et al, *A Novel Voltage-Programming Pixel with Current-Correction Method for Large-Size and High-Resolution AMOLEDs on Poly-Si Backplane*, IMID '05 Digest, Jul. 23, 2005, pp. 901-904, XP-002405123.
Matsueda, et al. *35.1: 2.5-in. AMOLED with Integrated 6-Bit Gamma Compensated Digital Data Driver*, SID 04 Digest, May 25, 2004, pp. 1116-1119, XP007011917.
Abstract of JP 2003-140613 A (1 page).
Abstract of JP 2004-219623 A (1 page).
Abstract of JP 2004-287345 A (1 page).

* cited by examiner

DATA DRIVER, ORGANIC LIGHT EMITTING DISPLAY DEVICE USING THE SAME, AND METHOD OF DRIVING THE ORGANIC LIGHT EMITTING DISPLAY DEVICE

CROSS-REFERENCE TO RELATED APPLICATIONS

This application is a divisional of U.S. patent application Ser. No. 11/501,245, filed Aug. 7, 2006, which claims priority to and the benefit of Korean Patent Applications No. 10-2005-0073047 and No. 10-2005-0073048, filed on Aug. 10, 2005, in the Korean Intellectual Property Office, the entire contents of all of which are incorporated herein by reference.

BACKGROUND

1. Field of the Invention

The present invention relates to a data driver, an organic light emitting display device using the same, and a method of driving the organic light emitting display device, and more particularly to, a data driver capable of displaying images with a substantially uniform brightness, an organic light emitting display device using the same, and a method of driving the organic light emitting display device.

2. Discussion of Related Art

Recently, various types of flat panel displays (FPDs) have been developed that reduced weight and volume compared to cathode ray tubes (CRT). The FPDs include liquid crystal displays (LCDs), field emission displays (FEDs), plasma display panels (PDPs), and organic light emitting display devices.

Among the FPDs, the organic light emitting display devices display images using organic light emitting diode devices that generate light by re-combination of electrons and holes. The organic light emitting display device has high response speed and is driven with low power consumption.

FIG. 1 illustrates the structure of a conventional organic light emitting display device.

Referring to FIG. 1, the conventional organic light emitting display device includes a display region 30 including a plurality of pixels 40 coupled to scan lines S1 to Sn and data lines D1 to Dm, a scan driver 10 for driving the scan lines S1 to Sn, a data driver 20 for driving the data lines D1 to Dm, and a timing controller 50 for controlling the scan driver 10 and the data driver 20.

The timing controller 50 generates data driving control signals DCS and scan driving control signals SCS in response to synchronizing signals supplied from the outside. The data driving control signals DCS generated by the timing controller 50 are supplied to the data driver 20 and the scan driving control signals SCS generated by the timing controller 50 are supplied to the scan driver 10. The timing controller 50 supplies the data Data supplied from the outside to the data driver 20.

The scan driver 10 receives the scan driving control signals SCS from the timing controller 50. The scan driver 10 then generates the scan signals to sequentially supply the generated scan signals to the scan lines S1 to Sn.

The data driver 20 receives the data driving control signals DCS from the timing controller 50. The data driver 20 then generates data signals and supplies the generated data signals to the data lines D1 to Dm in synchronization with the scan signals.

The display region 30 receives first and second power from a first power source ELVDD and a second power source ELVSS from the outside, respectively, and supplies the first and second power to the pixels 40. The pixels 40 then control the currents that flow from the first power source ELVDD to the second power source ELVSS via an organic light emitting diode devices in response to the data signals to generate light components corresponding to the data signals.

That is, according to the conventional organic light emitting display device, each of the pixels 40 generates light with predetermined brightness in response to each of the data signals. However, according to the conventional organic light emitting display device, due to non-uniformity in the threshold voltages of transistors included in the pixels 40 and deviation in electron mobility, it may not be possible to display images with desired brightness. While the threshold voltages of the transistors included in the pixels 40 may be compensated for by controlling the structure of the pixel circuits included in the pixels 40, the deviation in the electron mobility is not compensated for. Therefore, an organic light emitting display device capable of displaying images with a substantially uniform brightness regardless of the deviation in the electron mobility is desired.

SUMMARY OF THE INVENTION

Accordingly, it is an aspect of the present invention to provide a data driver for driving an organic light emitting display device capable of displaying images with a substantially uniform brightness, an organic light emitting display device using the same, and a method of driving the organic light emitting display device.

In order to achieve the foregoing and/or other aspects of the present invention, according to a first embodiment of the present invention, there is provided a data driver for use in an organic light emitting display device that comprises a plurality of current sink units for performing control so that predetermined currents flow through data lines, a plurality of voltage generators for resetting the values of gray scale voltages using compensation voltages generated when the predetermined currents flow, a plurality of digital-to-analog converters for selecting one gray scale voltage among the gray scale voltages as a data signal in response to the bit values of the data supplied from the outside, and a plurality of switching units for supplying the data signal to the data lines.

The current sink units may receive the predetermined currents from pixels coupled to the data lines. The current sink units receive the predetermined currents in a first period that is a part of a horizontal period. The values of the predetermined currents are the same as the values of the currents that flow when the pixels emit light with the maximum brightness.

According to a second embodiment of the present invention, there is provided a data driver for driving an organic light emitting display device. The data driver includes a precharging unit for supplying a precharging voltage to a pixel coupled to a data line, a current sink unit receiving a predetermined current from the pixel, a voltage generator for resetting the values of gray scale voltages using a compensation voltage generated when the predetermined current flows, a digital-to-analog converter for selecting one gray scale voltage among the values of the gray scale voltages as a data signal in response to the bit value of the data supplied from the outside to the data driver, and a switching unit for supplying the data signal to the data line.

The precharging unit may be located between the digital-to-analog converter and the switching unit.

According to a third embodiment of the present invention, there is provided a method of driving an organic light emitting display device, the method comprising of (a) controlling predetermined currents to flow in data lines coupled to pixels, (b) generating compensation voltages corresponding to the predetermined currents, (c) resetting the values of gray scale voltages using the compensation voltages, and (d) selecting one voltage among the gray scale voltages to correspond to the bit values of the data supplied from the outside to supply the selected voltage to the data line.

According to a fourth embodiment of the present invention, there is provided a method of driving an organic light emitting display device, the method comprising of supplying a predetermined precharging voltage to a pixel selected by a scan signal, supplying a predetermined current from the pixel to which the precharging voltage is supplied to a data driver, resetting the values of gray scale voltages using compensation voltages generated when the predetermined current is supplied, and selecting one of the gray scale voltages as a data signal to correspond to the bit values of the data supplied from the outside to supply the data signal to the pixel.

BRIEF DESCRIPTION OF THE DRAWINGS

These and/or other aspects and features of the invention will become apparent and more readily appreciated from the following description of the exemplary embodiments, taken in conjunction with the accompanying drawings of which.

DETAILED DESCRIPTION

Hereinafter, exemplary embodiments of the present invention will be described with reference to FIGS. 2 to 14.

Figure 1:
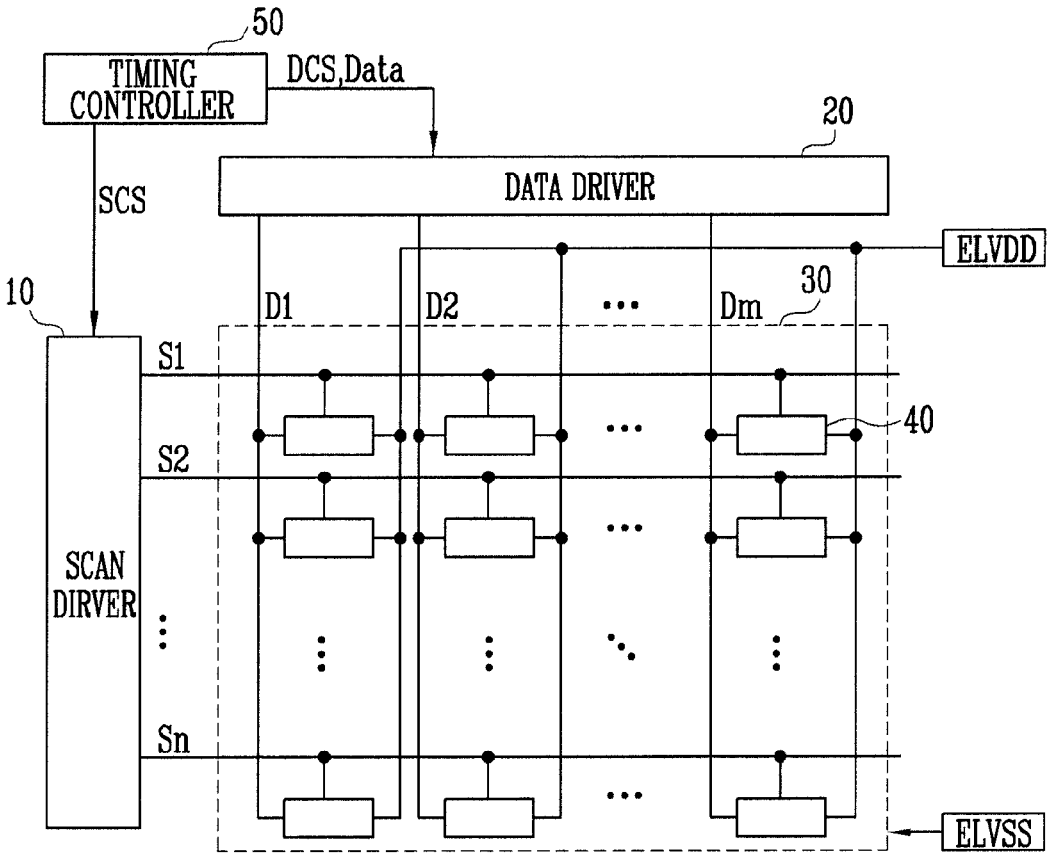
FIG. 1 (PRIOR ART)
FIG. 1 illustrates a conventional organic light emitting display device.
Figure 2:
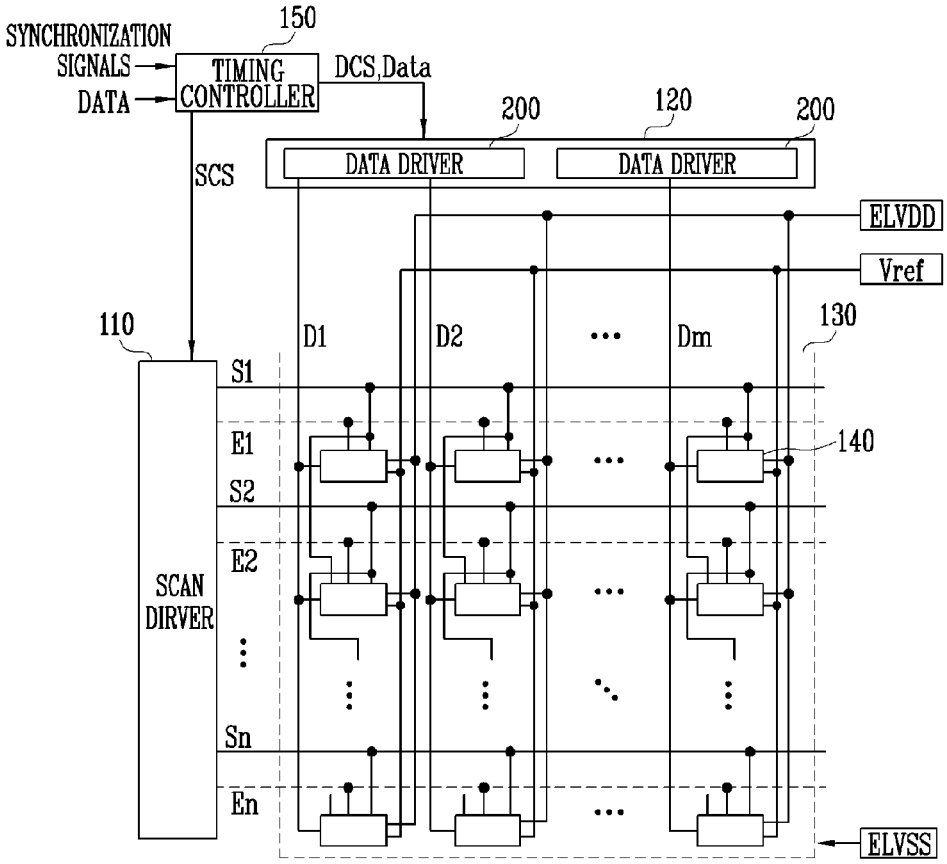
FIG. 2 illustrates an organic light emitting display device according to an embodiment of the present invention.

FIG. 2 illustrates an organic light emitting display device according to an embodiment of the present invention.

Referring to FIG. 2, the organic light emitting display device according to one embodiment of the present invention includes a display region 130 including a plurality of pixels 140 coupled to scan lines S1 to Sn, emission control lines E1 to En, and data lines D1 to Dm, a scan driver 110 for driving the scan lines S1 to Sn and the emission control lines E1 to En, a data driving part 120 for driving the data lines D1 to Dm, and a timing controller 150 for controlling the scan driver 110 and the data driving part 120.

The display region 130 includes the pixels 140 formed in the regions partitioned by the scan lines S1 to Sn, the emission control lines E1 to En, and the data lines D1 to Dm. The pixels 140 receive a first voltage from a first power source ELVDD, a second voltage from a second power source ELVSS, and a reference voltage from a reference power source Vref from the outside. The pixels 140 then compensate for drop of the voltage of the first power source ELVDD using a difference between the reference voltage of the reference power source Vref and the first voltage of the first power source ELVDD. The pixels 140 supply predetermined currents from the first power source ELVDD to the second power source ELVSS via organic light emitting diode devices (not shown) in response to data signals. Each of the pixels 140 may have the structure illustrated in FIG. 3 or 5. Detailed description of the structure of the pixel 140 illustrated in FIG. 3 or 5 will follow.

The timing controller 150 generates data driving control signals DCS and scan driving control signals SCS in response to synchronizing signals supplied from the outside. The data driving control signals DCS generated by the timing controller 150 are supplied to the data driving part 120 and the scan driving control signals SCS generated by the timing controller 150 are supplied to the scan driver 110. The timing controller 150 supplies data Data supplied from the outside to the data driving part 120.

The scan driver 110 receives the scan driving control signals SCS. The scan driver 110 then sequentially supplies scan signals to the scan lines S1 to Sn. The scan driver 110 also sequentially supplies emission control signals to the emission control lines E1 to En. Each of the emission control signals is supplied to overlap two scan signals. Therefore, a width of the emission control signals is equal to or larger than a width of the scan signals.

The data driving part 120 receives the data driving control signals DCS from the timing controller 150. The data driving part 120 then generates the data signals to be supplied to the data lines D1 to Dm. The data driving part 120 supplies predetermined currents to the data lines D1 to Dm in a first period of a horizontal period H and supplies predetermined voltages (representing the data signals) to the data lines D1 to Dm in a second period following the first period of the horizontal period H. Therefore, the data driving part 120 includes at least one data driver 200.

Figure 3:
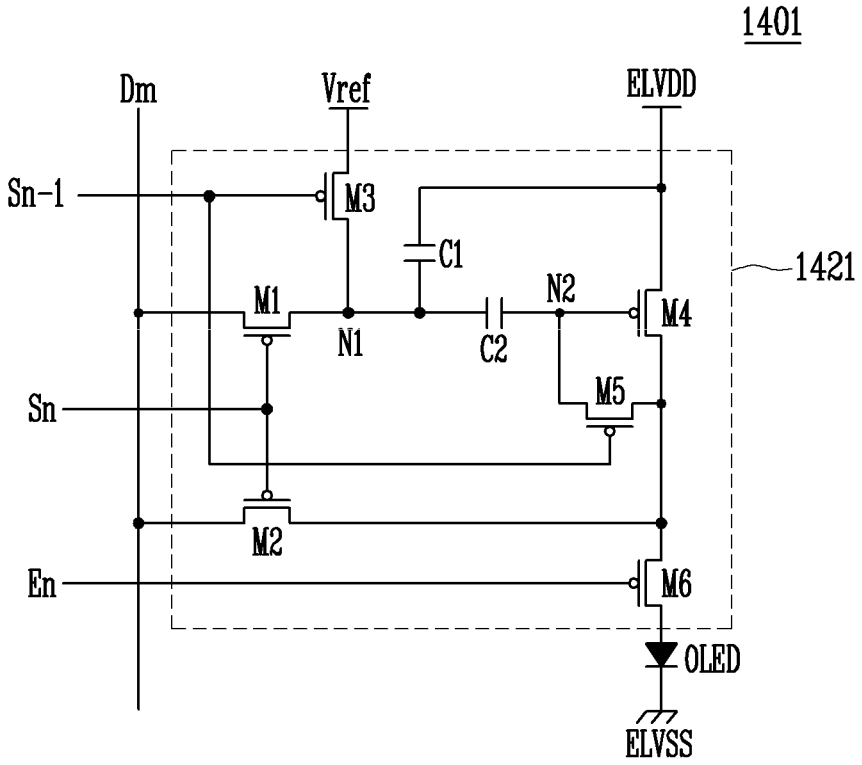
FIG. 3 is a circuit diagram illustrating an example of a pixel illustrated in FIG. 2.

FIG. 3 illustrates pixel 1401 which is an example of the pixel 140 illustrated in FIG. 2. In FIG. 3, for the sake of convenience, the pixel coupled to the mth data line Dm, the (n−1)th and nth scan lines Sn−1 and Sn, and the nth emission control line En is illustrated.

Referring to FIG. 3, the pixel 1401 in one embodiment of the present invention includes an organic light emitting diode (OLED) and a pixel circuit 1421 for supplying current to the OLED.

The OLED generates light of a predetermined color in response to the current supplied from the pixel circuit 1421.

The pixel circuit 1421 compensates for drop in the first voltage from the first power source ELVDD and a threshold voltage of a fourth transistor M4 when a scan signal is supplied to the (n−1)th scan line Sn−1 (the previous scan line) and charges the voltage corresponding to the data signal when the scan signal is supplied to the nth scan line Sn (the current or the present scan line). Therefore, the pixel circuit 1421 includes first, second, third, fourth, fifth, sixth transistors M1, M2, M3, M4, M5, and M6, a first capacitor C1, and a second capacitor C2. Each transistor has first and second electrodes and a gate electrode.

The first electrode of the first transistor M1 is coupled to the data line Dm and the second electrode of the first transistor M1 is coupled to a first node N1. The gate electrode of the first transistor M1 is coupled to the nth scan line Sn. The first transistor M1 is turned on when the scan signal is supplied to the nth scan line Sn to electrically connect the data line Dm and the first node N1 to each other.

The first electrode of the second transistor M2 is coupled to the data line Dm and the second electrode of the second transistor M2 is coupled to the second electrode of the fourth transistor M4. The gate electrode of the second transistor M2 is coupled to the nth scan line Sn. The second transistor M2 is turned on when the scan signal is supplied to the nth scan line Sn to electrically connect the data line Dm and the second electrode of the fourth transistor M4 to each other.

The first electrode of the third transistor M3 is coupled to the reference power source Vref and the second electrode of the third transistor M3 is coupled to the first node N1. The gate electrode of the third transistor M3 is coupled to the (n−1)th scan line Sn−1. The third transistor M3 is turned on when the scan signal is supplied to the (n−1)th scan line Sn−1 to electrically connect the reference power source Vref and the first node N1 to each other.

The first electrode of the fourth transistor M4 is coupled to the first power source ELVDD and the second electrode of the fourth transistor M4 is coupled to the first electrode of the sixth transistor M6. The gate electrode of the fourth transistor M4 is coupled to a second node N2. The fourth transistor M4 supplies the current corresponding to the voltage applied to the second node N2, that is, the voltage charged in the first and second capacitors C1 and C2, to the first electrode of the sixth transistor M6.

The second electrode of the fifth transistor M5 is coupled to the second node N2 and the first electrode of the fifth transistor M5 is coupled to the second electrode of the fourth transistor M4. The gate electrode of the fifth transistor M5 is coupled to the (n−1)th scan line Sn−1. The fifth transistor M5 is turned on when the scan signal is supplied to the (n−1)th scan line Sn−1 so that current flows through the fourth transistor M4 and that the fourth transistor M4 operates as a diode.

The first electrode of the sixth transistor M6 is coupled to the second electrode of the fourth transistor M4 and the second electrode of the sixth transistor M6 is coupled to the anode electrode of the OLED. The gate electrode of the sixth transistor M6 is coupled to the nth emission control line En. The sixth transistor M6 is turned off when an emission control signal is supplied to the nth emission control line En and is turned on when no emission control signal is supplied. Here, the emission control signal supplied to the nth emission control line En is supplied to overlap the scan signals supplied to the (n−1)th scan line Sn−1 and the nth scan line Sn. Therefore, the sixth transistor M6 is turned off when the scan signal is supplied to the (n−1)th scan line Sn−1 and the nth scan line Sn so that predetermined voltage is charged in the first and second capacitors C1 and C2 and is turned on in the other cases to electrically connect the fourth transistor M4 and the OLED to each other. While in FIG. 3, for the sake of convenience, the transistors M1 to M6 are shown as PMOS transistors, the present invention is not limited to a circuit including PMOS transistors.

In the pixel 1401 illustrated in FIG. 3, the reference power source Vref does not supply current to the OLED. Since the reference power source Vref does not supply current to the pixel 1401, a drop in voltage is not generated. Therefore, it is possible to maintain the voltage value of the reference power source Vref uniform regardless of the positions of the pixels 140. The voltage value of the reference power source Vref may be equal to or different from the voltage of the first power source ELVDD.

Figure 4:
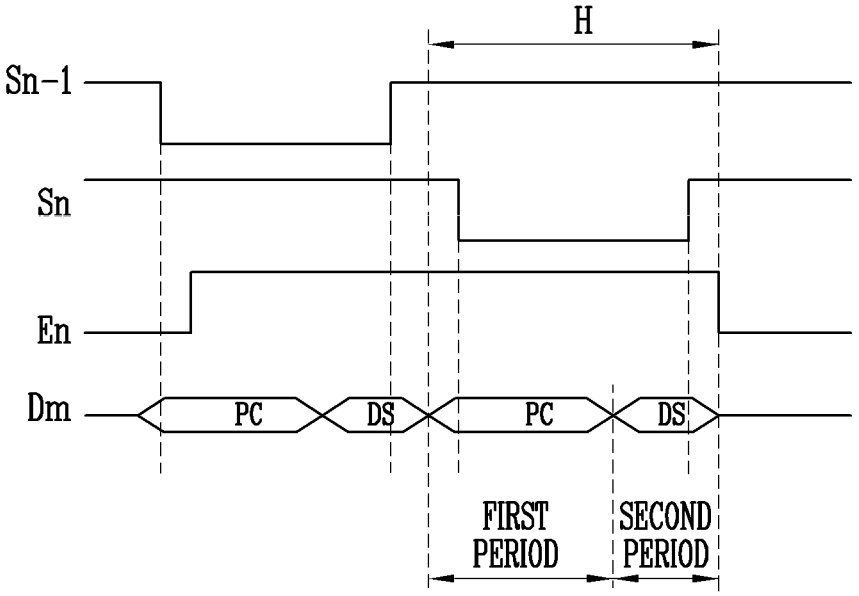
FIG. 4 illustrates waveforms that describe a method of driving the pixel illustrated in FIG. 3.

FIG. 4 illustrates waveforms that describe a method of driving the pixel illustrated in FIG. 3. In FIG. 4, a horizontal period H is divided into a first period and a second period to be driven. In the first period, a predetermined current (PC) flows to the data lines D1 to Dm. In the second period, a data signal DS is supplied to the data lines D1 to Dm. The PC is supplied from the pixel 1401 to one of the data drivers 200 which operates as a current sink.

The data signal DS is supplied from the data driver 200 to the pixel 1401. Hereinafter, for the sake of convenience, it is assumed that the initial voltage value of the reference power source Vref is equal to the initial voltage value of the first power source ELVDD.

Operation processes will be described in detail with reference to FIGS. 3 and 4. First, the scan signal is supplied to the (n−1)th scan line Sn−1. When the scan signal is supplied to the (n−1)th scan line Sn−1, the third and fifth transistors M3 and M5 are turned on. When the fifth transistor M5 is turned on, current flows through the fourth transistor M4 and the fourth transistor M4 operates as a diode. When the fourth transistor M4 operates as a diode, the voltage value obtained by subtracting the threshold voltage of the fourth transistor M4 from the first power source ELVDD is applied to the second node N2.

When the third transistor M3 is turned on, the voltage of the reference power source Vref is applied to the first node N1. At this time, the second capacitor C2 is charged with the voltage corresponding to difference between the first node N1 and the second node N2. In this case, when it is assumed that the reference power source Vref is equal to the voltage value of the first power source ELVDD, the voltage corresponding to the threshold voltage of the fourth transistor M4 is charged in the second capacitor C2. When predetermined drop in voltage is generated in the first power source ELVDD, the threshold voltage of the fourth transistor M4 and the voltage corresponding to the voltage drop of the first power source ELVDD are charged in the second capacitor C2. That is, according to the present invention, in the period where the scan signal is supplied to the (n−1)th scan line Sn−1, the voltage corresponding to the voltage drop of the first power source ELVDD and the threshold voltage of the fourth transistor M4 are charged in the second capacitor C2.

Accordingly, it is possible to compensate for the voltage drop of the first power source ELVDD.

After a predetermined voltage is charged in the second capacitor C2, the scan signal is supplied to the nth scan line Sn. When the scan signal is supplied to the nth scan line Sn, the first and second transistors M1 and M2 are turned on. When the second transistor M2 is turned on, in the first period of the horizontal period H, the PC is supplied from the pixel 1401 to the data driver 200 via the data line Dm. In more detail, the PC is supplied to the data driver 200 via the first power source ELVDD, the fourth transistor M4, the second transistor M2, and the data line Dm. At this time, a predetermined voltage is charged in the first and second capacitors C1 and C2 in response to the PC.

On the other hand, the data driver 200 resets the voltage of a gamma voltage unit (not shown) using a compensation voltage generated when the PC sinks to generate the data signal DS using the reset voltage of the gamma voltage unit. Then, the data signal DS is supplied to the first node N1 via the first transistor M1 in the second period of the horizontal period H. Then, the voltage corresponding to a difference between the data signal DS and the voltage of the first power source ELVDD is charged in the first capacitor C1. At this time, since the second node N2 floats, the second capacitor C2 maintains the previously charged voltage.

That is, according to the described embodiment of the present invention, in the period where the scan signal is supplied to one of the scan lines, called a previous scan line (i.e., Sn−1), the threshold voltage of the fourth transistor M4 and the voltage corresponding to the voltage drop of the first power source ELVDD are charged in the second capacitor C2 so that it is possible to compensate for the voltage drop of the first power source ELVDD and the threshold voltage of the fourth transistor M4. According to the described embodiment of the present invention, the voltage of the gamma voltage unit is reset so that the electron mobility of the transistors included in the pixel 1401 is compensated for during the period in which the scan signal is supplied to the next scan line, called a current or a present scan line (i.e., Sn), and the generated data signal is supplied using the reset gamma voltage. Therefore, according to the described embodiment of the present invention, non-uniformity in the threshold voltages of the transistors and the electron mobility is compensated for, so that it is possible to display images with a substantially uniform brightness. Processes of resetting the voltage of the gamma voltage unit will be described later.

Figure 5:
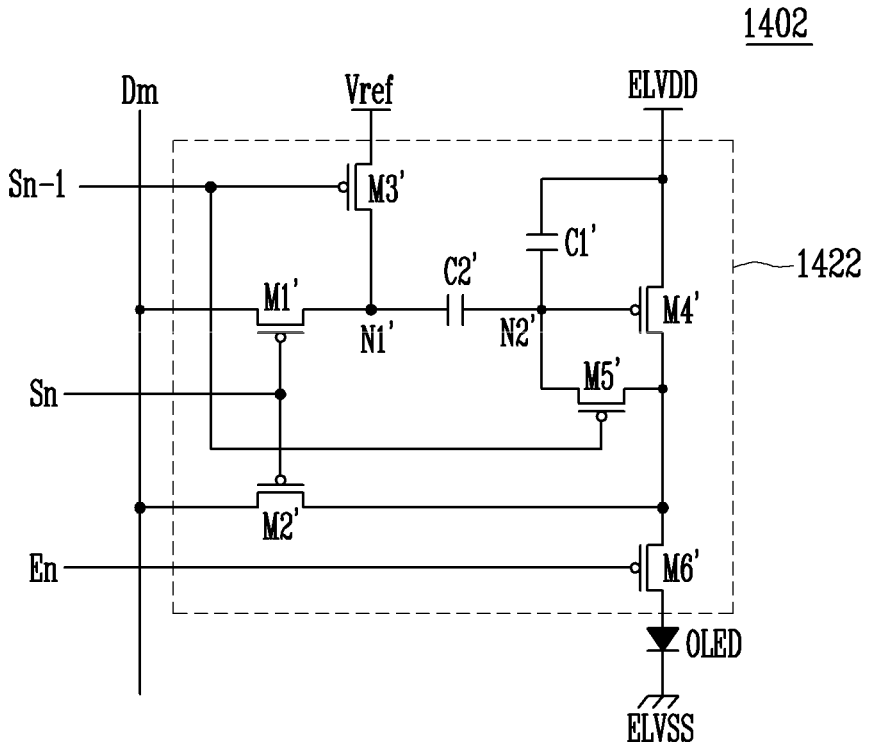
FIG. 5 is a circuit diagram illustrating another example of the pixel illustrated in FIG. 2.

FIG. 5 illustrates a pixel 1402 which is another example of the pixel 140 illustrated in FIG. 2. The pixel 1402 includes a pixel circuit 1422 that includes first, second, third, fourth, fifth, and sixth transistors M1', M2', M3', M4', M5', and M6', a first capacitor C1', and a second capacitor C2'. Each transistor has first and second electrodes and a gate electrode. The structure of the pixel 1402 illustrated in FIG. 5 is the same as the structure of the pixel 1401 illustrated in FIG. 3 except that the first capacitor C1' is now provided between the second node N2' and the first power source ELVDD.

Operation processes will be described in detail with reference to FIGS. 4 and 5. First, the scan signal is supplied to the (n−1)th scan line Sn−1. When the scan signal is supplied to the (n−1)th scan line Sn−1, the third and fifth transistors M3' and M5' are turned on. When the fifth transistor M5' is turned on, current flows through the fourth transistor M4' so that the fourth transistor M4' operates as a diode. When the fourth transistor M4' operates as a diode, the voltage value obtained by subtracting the threshold voltage of the fourth transistor M4' from the first power source ELVDD is applied to the second node N2'. Therefore, the voltage corresponding to the threshold voltage of the fourth transistor M4' is charged in the first capacitor C1'.

When the third transistor M3' is turned on, the voltage of the reference power source Vref is applied to the first node N1'. Then, the second capacitor C2' charges the voltage corresponding to a difference between the first node N1' and the second node N2'. Here, since the first and second transistors M1' and M2' are turned off in the period where the scan signal is supplied to the (n−1)th scan line Sn−1, the data signal DS is not supplied to the pixel 1402.

Then, the scan signal is supplied to the nth scan line Sn so that the first and second transistors M1 and M2' are turned on. When the second transistor M2' is turned on, in the first period of the horizontal period H, the PC is supplied from the pixel 1402 to the data driver 200 via the data line Dm. Actually, the PC is supplied to the data driver 200 via the first power source ELVDD, the fourth transistor M4', the second transistor M2', and the data line Dm. At this time, a predetermined voltage is charged in the first and second capacitors C1' and C2' in response to a first data signal DS1.

The data driver 200 resets the voltage of the gamma voltage unit (not shown) using the compensation voltage applied in response to the PC to generate the data signal DS using the reset voltage of the gamma voltage unit. Then, in the second period of the horizontal period H, the data signal DS is supplied to the first node N1'. Then, the predetermined voltage corresponding to the data signal DS is charged in the first and second capacitors C1' and C2'.

Actually, when the data signal DS is supplied, the voltage of the first node N1' falls from the voltage of the reference power source Vref to the voltage of the data signal DS. Since the second node N2' floats, the voltage at the second node N2' is reduced in response to the amount of voltage drop of the first node N1'. The amount of reduction in the voltage of the second node N2' is determined by the capacitance values of the first and second capacitors C1' and C2'.

When the voltage of the second node N2' falls, the predetermined voltage corresponding to the voltage value of the second node N2' is charged in the first capacitor C1'. Here, since the voltage value of the reference power source Vref is fixed, the voltage charged in the first capacitor C1' is determined by the data signal DS. That is, since the voltage values charged in the capacitors C1' and C2' are determined by the reference power source Vref and the data signal DS in the pixel 1402 illustrated in FIG. 5, it is possible to charge a desired voltage regardless of the voltage drop of the first power source ELVDD.

According to the described embodiments of the present invention, the voltage of the gamma voltage unit is reset to compensate for the electron mobility of the transistors included in the pixel 1402 and to supply the generated data signal using the reset gamma voltage. Therefore, according to the described embodiments of the present invention, non-uniformity in the threshold voltages of the transistors and deviation in the electron mobility of the transistors is compensated for so that it is possible to display images with a substantially uniform brightness.

Figure 6:
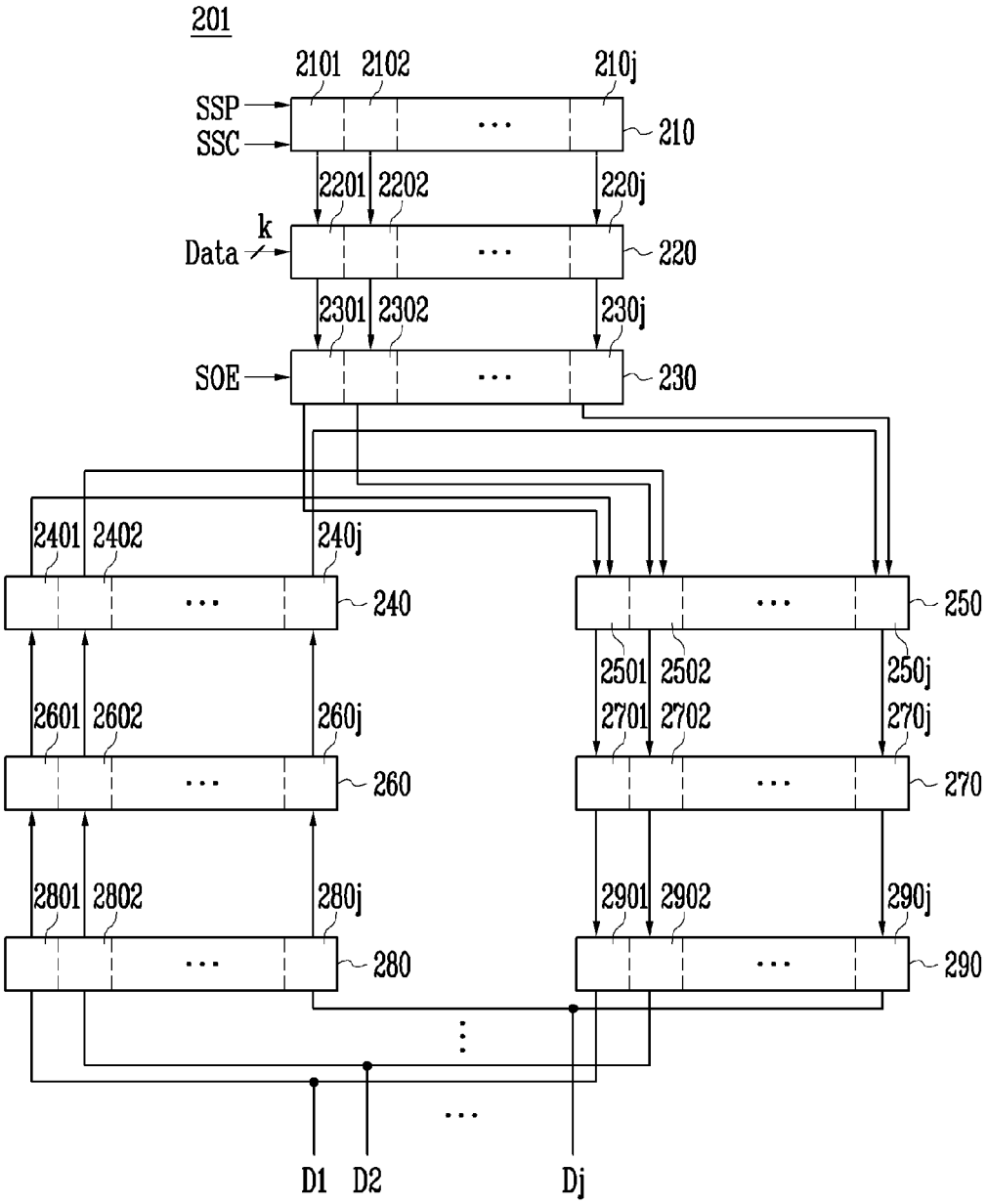
FIG. 6 is a block diagram illustrating an example of the data driver illustrated in FIG. 2.

FIG. 6 is a block diagram illustrating an exemplary embodiment of a data driver 201, which is an example of the data driver 200 illustrated in FIG. 2. In FIG. 6, for the sake of convenience, it is assumed that the data driver 201 has j (j is a natural number not less than 2) channels.

Referring to FIG. 6, the data driver 201 according to the embodiment of the present invention includes a shift register unit 210, a sampling latch unit 220, a holding latch unit 230, a gamma voltage unit 240, a digital-to-analog converter unit (hereinafter, referred to as a DAC) 250, a first buffer unit 270, a second buffer unit 260, a current supplying unit 280, and a selector 290.

The shift register unit 210 receives a source shift clock SSC and a source start pulse SSP from the timing controller 150. The shift register unit 210 then sequentially generates j sampling signals while shifting the source start pulse SSP every one period of the source shift clock SSC. Therefore, the shift register unit 210 includes j shift registers 2101 to 210*j*.

The sampling latch unit 220 sequentially stores the data Data in response to the sampling signals sequentially supplied from the shift register unit 210. Here, the sampling latch unit 220 includes j sampling latches 2201 to 220*j* in order to store the j data Data. Each of the sampling latches 2201 to 220*j* has the magnitude corresponding to the number of bits of the data Data. For example, when the data Data is composed of k bits, each of the sampling latches 2201 to 220*j* has the magnitude of k bits.

The holding latch unit 230 receives the data Data from the sampling latch unit 220 to store the data Data when a source output enable signal SOE is input. The holding latch unit 230 supplies the data Data stored therein to the DAC unit 250, when the source output enable signal SOE is input. Here, the holding latch unit 230 includes j holding latches 2301 to 230*j* in order to store the j data Data. Each of the holding latches 2301 to 230*j* has the magnitude corresponding to the number of bits of the data Data. For example, each of the holding latches 2301 to 230*j* has the magnitude of k bits to store the data Data.

Figure 8:
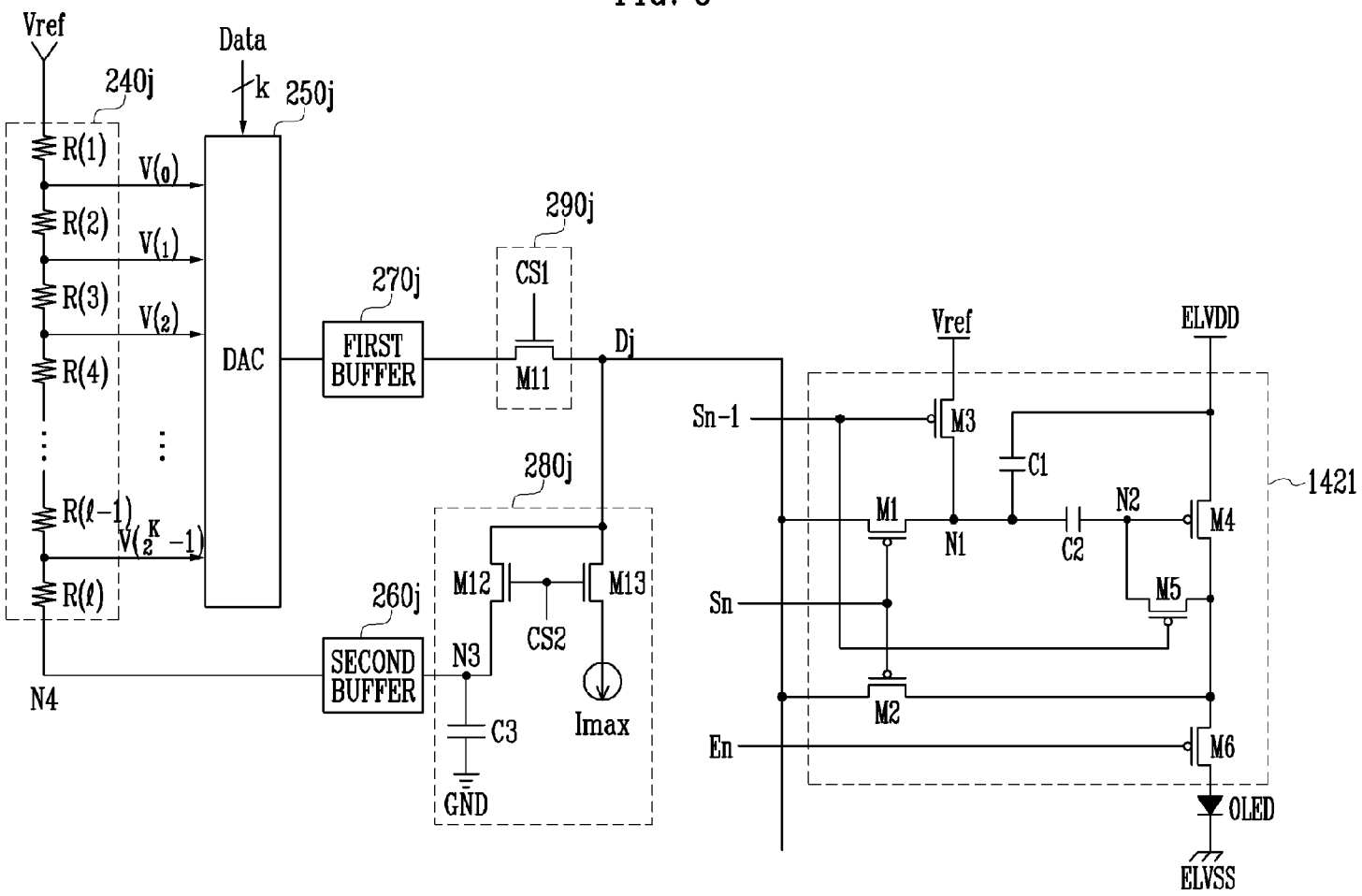
FIG. 8 illustrates an example of a connection among a voltage generator, a digital-to-analog converter, a first buffer, a second buffer, a switching unit, a current sink unit, and a pixel.

The gamma voltage unit 240 includes j voltage generators 2401 to 240*j* for generating predetermined gray scale voltage in response to the data Data of k bits. As illustrated in FIG. 8, each of the voltage generators 2401 to 240*j* is composed of a plurality of voltage dividing resistors R(1) to R(I) to generate $2^k$ gray scale voltages. Here, the voltage generators 2401 to 240*j* reset the values of the gray scale voltages using the compensation voltage supplied from the second buffer unit 260 to supply the reset gray scale voltages to the DACs 2501 to 250*j*.

The DAC unit 250 includes j DACs 2501 to 250*j* that generate the data signal DS in response to the bit values of the data Data. Each of the DACs 2501 to 250*j* selects one of the plurality of gray scale voltages in response to the bit values of the data Data supplied from the holding latch unit 230 to generate a second data signal DS2.

The first buffer unit 270 supplies the data signals DS supplied from the DAC unit 250 to the selector 290. Therefore, the first buffer unit 270 includes j first buffers 2701 to 270*j*.

The selector 290 controls electrical connection between the data lines D1 to Dj and the first buffers 2701 to 270*j*. Actually, the selector 290 electrically connects the data lines D1 to Dj and the first buffers 2701 to 270*j* to each other only in the second period of the horizontal period H and does not connect the data lines D1 to Dj and the first buffers 2701 to 270*j* to each other in the other period. Therefore, the selector 290 includes j switching units 2901 to 290*j*.

The current supplying unit 280 sinks the PC from the pixels 140 coupled to the data lines D1 to Dj in the first period of the horizontal period H. Actually, the current supplying unit 280 sinks the maximum current that can flow through each of the pixels 140, that is, the current to be supplied to the OLED when the pixel 140 emits light with the maximum brightness. The current supplying unit 280 supplies a predetermined compensation voltage generated when the current sinks to the second buffer unit 260. Therefore, the current supplying unit 280 includes j current sink units 2801 to 280*j*.

The second buffer unit 260 supplies the compensation voltage supplied from the current supplying unit 280 to the gamma voltage unit 240. Therefore, the second buffer unit 260 includes j second buffers 2601 to 260*j*.

Figure 7:
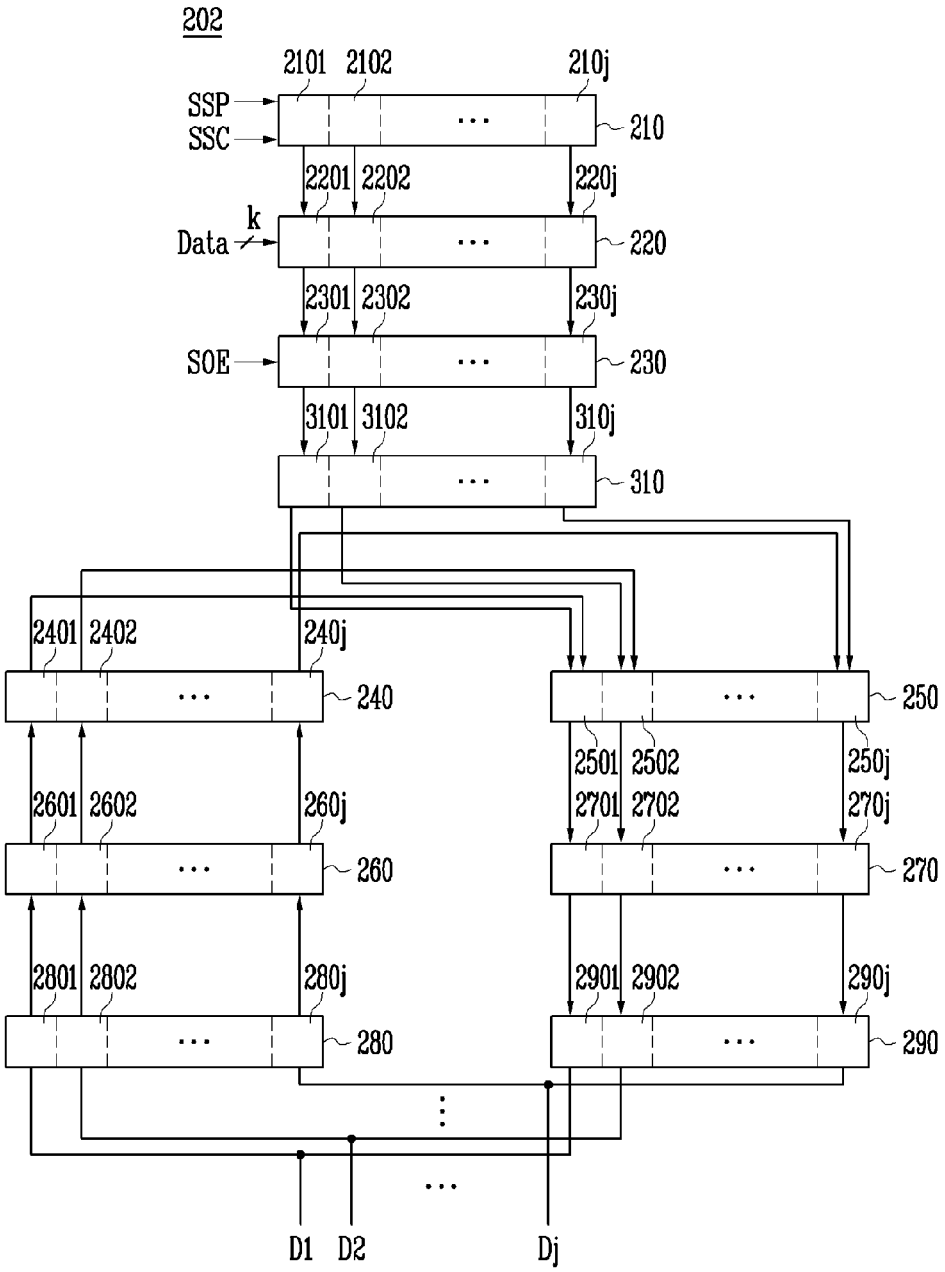
FIG. 7 is a block diagram illustrating another example of the data driver illustrated in FIG. 2.

On the other hand, as illustrated in FIG. 7, a data driver 202, which is an example of the data driver 200 according to one exemplary embodiment of the present invention may further include a level shifter unit 310 after the holding latch unit 230. The level shifter unit 310 increases the voltage levels of the data Data supplied from the holding latch unit 230 to supply the data Data to the DAC unit 250. When the data Data having a high voltage level are supplied from an external system to the data driver 200, circuit parts having a high voltage resistant property must be provided in response to the voltage level so that manufacturing cost increases. Therefore, the data Data having a low voltage level are supplied from the outside of the data driver 200 and the low voltage level is transited to a high voltage level by the level shifter unit 310.

FIG. 8 illustrates a connection among the voltage generator, the DAC, the first buffer, the second buffer, the switching unit, the current sink unit, and the pixel circuit provided in a specific channel. In FIG. 8, for the sake of convenience, a jth channel is illustrated and it is assumed that the data line Dj is coupled to the pixel circuit 1421 of the pixel 1401 illustrated in FIG. 3.

Referring to FIG. 8, the voltage generator 240*j* includes a plurality of voltage dividing resistors R(1) to R(I). The voltage dividing resistors R(1) to R(I) are positioned between the reference power source Vref and the second buffer 260*j*. The voltage dividing resistors R(1) to R(I) divide the voltage between the voltage of the reference power source Vref and the compensation voltage supplied from the second buffer 260*j* to generate a plurality of gray scale voltages to V(0) to $V(2^k-1)$ and to supply the generated gray scale voltages to the DAC 250*j*.

The DAC 250*j* selects one gray scale voltage among the gray scale voltages V(0) to $V(2^k-1)$ in response to the bit values of the data Data to supply the selected gray scale voltage to the first buffer 270*j*. Here, the gray scale voltage selected by the DAC 250*j* is used as the data signal DS.

The first buffer 270*j* transmits the data signal DS supplied from the DAC 250*j* to the switching unit 290*j*.

The switching unit 290*j* includes an $11^{th}$ transistor M11. The $11^{th}$ transistor M11 is controlled by the first control signal CS1 illustrated in FIG. 9. That is, the $11^{th}$ transistor M11 is turned on in the second period of the horizontal period H and is turned off in the first period. Therefore, the data signal DS is supplied to the data line Dj in the second period of the horizontal period H and is not supplied in the other period.

The current sink unit 280*j* includes $12^{th}$ and $13^{th}$ transistors M12 and M13 controlled by the second control signal CS2, a current source Imax coupled to the first electrode of the $13^{th}$ transistor M13, and a third capacitor C3 coupled between a third node N3 and a ground voltage source GND. The $12^{th}$ and $13^{th}$ transistors M12 and M13 each have a gate electrode and first and second electrodes.

The gate electrode of the $12^{th}$ transistor M12 is coupled to the gate electrode of the $13^{th}$ transistor M13 and the second electrode of the $12^{th}$ transistor M12 is coupled to the second electrode of the $13^{th}$ transistor M13 and the data line Dj. The first electrode of the $12^{th}$ transistor M12 is coupled to the second buffer 260*j*. The $12^{th}$ transistor M12 is turned on in the first period of the horizontal period H by the second control signal CS2 and is turned off in the second period.

The first electrode of the $13^{th}$ transistor M13 is coupled to the current source Imax. The $13^{th}$ transistor M13 is also turned on by the second control signal CS2 in the first period of the horizontal period H and is turned off in the second period.

The current source Imax receives the current to be supplied to the OLED when the pixel 1401 emits light with a maximum brightness in the first period where the $12^{th}$ and $13^{th}$ transistors M12 and M13 are turned on.

The third capacitor C3 stores the compensation voltage applied to the third node N3 when the current source Imax operates as a current sink for the current from the pixel 1401. The third capacitor C3 that has been charged with the compensation voltage in the first period, maintains the compensation voltage of the third node N3 uniform even when the $12^{th}$ and $13^{th}$ transistors M12 and M13 are turned off in the second period.

The second buffer 260*j* transmits the compensation voltage applied to the third node N3, that is, the voltage charged in the third capacitor C3 to the voltage generator 240*j*. Then, the voltage generator 240*j* divides the voltage between the voltage of the reference power source Vref and the compensation voltage supplied from the second buffer 260*j*. Here, the compensation voltage applied to the third node N3 is set to be the same or to vary in each pixel 140 in accordance with the electron mobility of the transistors included in the pixel 140. The compensation voltage supplied to the j voltage generators 2401 to 240*j* is determined by the currently coupled pixel 140.

On the other hand, when different compensation voltages are supplied to the j voltage generators 2401 to 240*j*, the values of the gray scale voltages V(0) to $V(2^k-1)$ supplied to the DACs 2501 to 250*j* provided in the j channels are set to be different from each other. Here, since the gray scale voltages V(0) to $V(2^k-1)$ are controlled by the pixels 140 to which the data lines D1 to Dj are currently coupled, although the electron mobility of the transistors included in the pixels 140 is non-uniform, the display region 130 can display images with a substantially uniform brightness.

Figure 9:
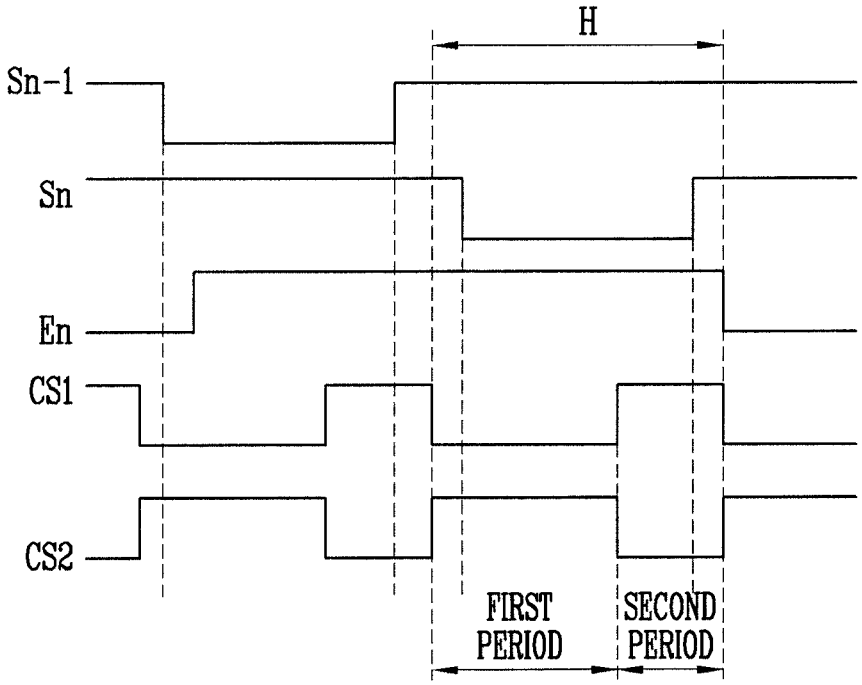
FIG. 9 illustrates a method of driving the pixel, the switching unit, and the current sink unit illustrated in FIG. 8.

FIG. 9 illustrates driving waveforms supplied to the switching unit, the current sink unit, and the pixel illustrated in FIG. 8.

The voltage value of the data signal DS supplied to the pixel 140 will be described in detail with reference to FIGS. 8 and 9. First, the scan signal is supplied to the (n−1)th scan line Sn−1. When the scan signal is supplied to the (n−1)th scan line Sn−1, the third and fifth transistors M3 and M5 are turned on. Then, the voltage value obtained by subtracting the threshold voltage of the fourth transistor M4 from the first power source ELVDD is applied to the second node N2 and the voltage of the reference power source Vref is applied to the first node N1. At this time, the voltage corresponding to the voltage drop of the first power source ELVDD and the threshold voltage of the fourth transistor M4 are charged in the second capacitor C2.

Actually, the voltages applied to the first node N1 and the second node N2 are represented by EQUATION 1.

$$V_{N1}=V\text{ref}$$

$$V_{N2}=ELVDD-|V_{thM4}| \qquad \text{[EQUATION 1]}$$

wherein, $V_{N1}$, $V_{N2}$, and $V_{thM4}$ represent the voltage applied to the first node N1, the voltage applied to the second node N2, and the threshold voltage of the fourth transistor M4, respectively.

On the other hand, in a period between the point of time when the scan signal supplied to the (n−1)th scan line Sn−1 is turned off and the point of time when the scan signal is supplied to the nth scan line Sn, the first and second nodes N1 and N2 float. Therefore, the voltage value charged in the second capacitor C2 does not change.

Then, the scan signal is supplied to the nth scan line Sn so that the first and second transistors M1 and M2 are turned on. While the scan signal is supplied to the nth scan line Sn, in the first period, the $12^{th}$ and $13^{th}$ transistors M12 and M13 are also turned on. When the $12^{th}$ and $13^{th}$ transistors M12 and M13 are turned on, a current flows through the current source Imax via the first power source ELVDD, the fourth transistor M4, the second transistor M2, the data line Dj, and the $13^{th}$ transistor M13 and the current source Imax operates as a current sink for this current.

At this time, since the current of the current source Imax flows through the fourth transistor M4, EQUATION 2 is obtained.

$$I_{max}=\frac{1}{2}\mu_p C_{ox}\frac{W}{L}(ELVDD-V_{N2}-|V_{thM4}|)^2 \qquad \text{[EQUATION 2]}$$

wherein, μ, Cox, W, and L represent electron mobility, the capacity of an oxide layer, the width of a channel, and the length of a channel, of the fourth transistor M4, respectively.

The voltage applied to the second node N2 when the current obtained by EQUATION 2 flows through the fourth transistor M4 may be represented by EQUATION 3.

$$V_{N2}=ELVDD-\sqrt{\frac{2Imax}{\mu_p C_{ox}}\frac{L}{W}}-|V_{thM4}| \qquad \text{[EQUATION 3]}$$

The voltage applied to the first node N1 may be represented by EQUATION 4 by the coupling of the second capacitor C2.

$$V_{N1}=Vref-\sqrt{\frac{2Imax}{\mu_p C_{ox}}\frac{L}{W}}=V_{N3}=V_{N4} \qquad \text{[EQUATION 4]}$$

wherein, the voltage $V_{N1}$ applied to the first node N1 may be equal to the voltage $V_{N3}$ applied to the third node N3 and the voltage $V_{N4}$ applied to a fourth node N4 formed between the second buffer 260*j* and the voltage generator 240*j*. That is, when the current is sunk by the current source Imax, the voltage obtained by EQUATION 4 is applied to the fourth node N4.

However, as illustrated by EQUATION 4, the voltage applied to the third node N3 and the fourth node N4 is affected by the electron mobility of the transistors included in the pixel 140 the current from which sinks into the current source Imax. Therefore, the value of the voltage applied at the third node N3 and the fourth node N4 when the current is sunk by the current source Imax varies in each of the pixels 140 according to the electron mobility of each of the pixels 140.

When the voltage obtained by EQUATION 4 is applied to the fourth node N4, a voltage $V_{diff}$ across the voltage generator 240*j* may be represented by EQUATION 5.

$$V_{diff} = Vref - \left(Vref - \sqrt{\frac{2Imax}{\mu_p C_{OX}} \frac{L}{W}}\right) \quad \text{[EQUATION 5]}$$

When the DAC 250*j* selects the hth (h is a natural number) gray scale voltage among f (f is a natural number less than or equal to h) gray scale voltages in response to the data Data, the voltage Vb supplied to the first buffer 270*j* may be represented by EQUATION 6.

$$Vb = Vref - \frac{h}{f}\sqrt{\frac{2Imax}{\mu_p C_{OX}} \frac{L}{W}} \quad \text{[EQUATION 6]}$$

After the current sinks in the first period so that the voltage obtained by EQUATION 4 is charged in the third capacitor C3, the 12$^{th}$ and 13$^{th}$ transistors M12 and M13 are turned off in the second period and the 11$^{th}$ transistor M11 is turned on. At this time, the third capacitor C3 maintains the voltage value charged therein. Therefore, the voltage value of the third node N3 may be maintained as illustrated in EQUATION 4.

Since the 11$^{th}$ transistor M11 is turned on in the second period, the voltage supplied to the first buffer 270*j* is supplied to the first node N1 via the 11$^{th}$ transistor M11, the data line Dj, and the first transistor M1. That is, the voltage obtained by EQUATION 6 is supplied to the first node N1. The voltage applied to the second node N2 by the coupling of the second capacitor C2 may be represented by EQUATION 7.

$$V_{N2} = ELVDD - \frac{h}{f}\sqrt{\frac{2Imax}{\mu_p C_{OX}} \frac{L}{W}} - |V_{thM4}| \quad \text{[EQUATION 7]}$$

At this time, the current that flows via the fourth transistor M4 may be represented by EQUATION 8.

$$\begin{aligned} I_{M4} &= \frac{1}{2}\mu_p C_{OX} \frac{W}{L}(ELVDD - V_{N2} - |V_{thM4}|)^2 \\ &= \frac{1}{2}\mu_p C_{OX} \frac{W}{L} \left(ELVDD - \left(ELVDD - \frac{h}{f}\sqrt{\frac{2Imax}{\mu_p C_{OX}} \frac{L}{W}} - |V_{thM4}|\right) - V_{thM4}\right)^2 \\ &= \left(\frac{h}{f}\right)^2 Imax \end{aligned} \quad \text{[EQUATION 8]}$$

Referring to EQUATION 8, according to the present invention, the current that flows through the fourth transistor M4 is determined by the gray scale voltage generated by the voltage generator 240*j*. That is, according to the present invention, the current determined by the gray scale voltage can flow to the fourth transistor M4 regardless of the threshold voltage and electron mobility of the fourth transistor M4. Therefore, it is possible to display images with a substantially uniform brightness.

Figure 10:
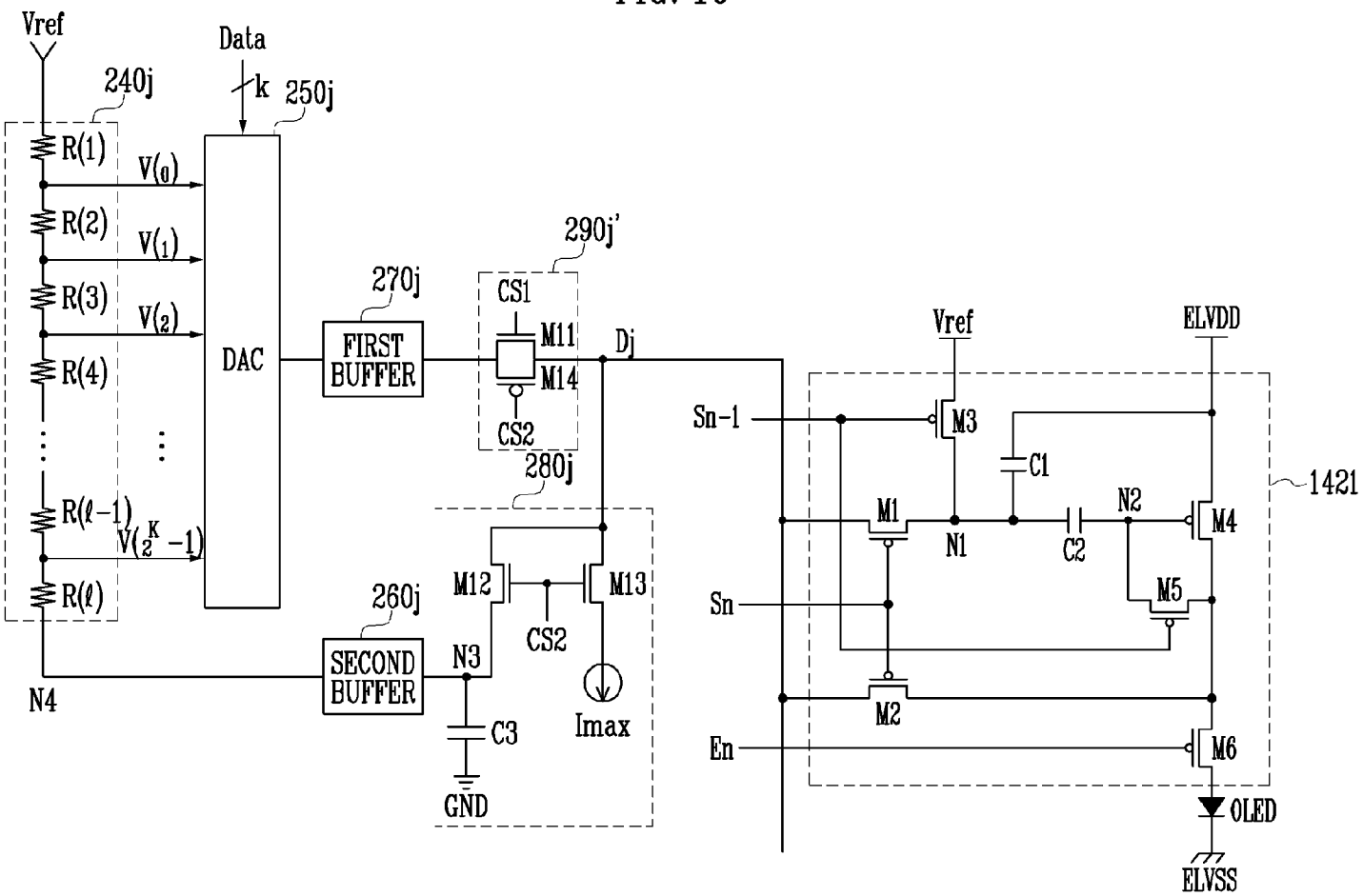
FIG. 10 illustrates another example of the switching unit illustrated in FIG. 8.

On the other hand, according to the present invention, the structure of the switching unit 290*j* may vary. For example, in the switching unit 290*j*', as illustrated in FIG. 10, the 11$^{th}$ transistor M11 and a 14$^{th}$ transistor M14 may be coupled to each other in the form of a transmission gate. The 14$^{th}$ transistor M14 formed of PMOS receives a second control signal CS2. The 11$^{th}$ transistor M11 formed of NMOS receives the first control signal CS1. As shown in FIG. 9, since the polarity of the first control signal CS1 is opposite to the polarity of the second control signal CS2, the 11$^{th}$ and 14$^{th}$ transistors M11 and M14 are turned on and off at the same time.

On the other hand, when the 11$^{th}$ and 14$^{th}$ transistors M11 and M14 are coupled to each other in the form of the transmission gate, a voltage-current characteristic curve is in the form of a straight line so that it is possible to minimize switching error.

Figure 11:
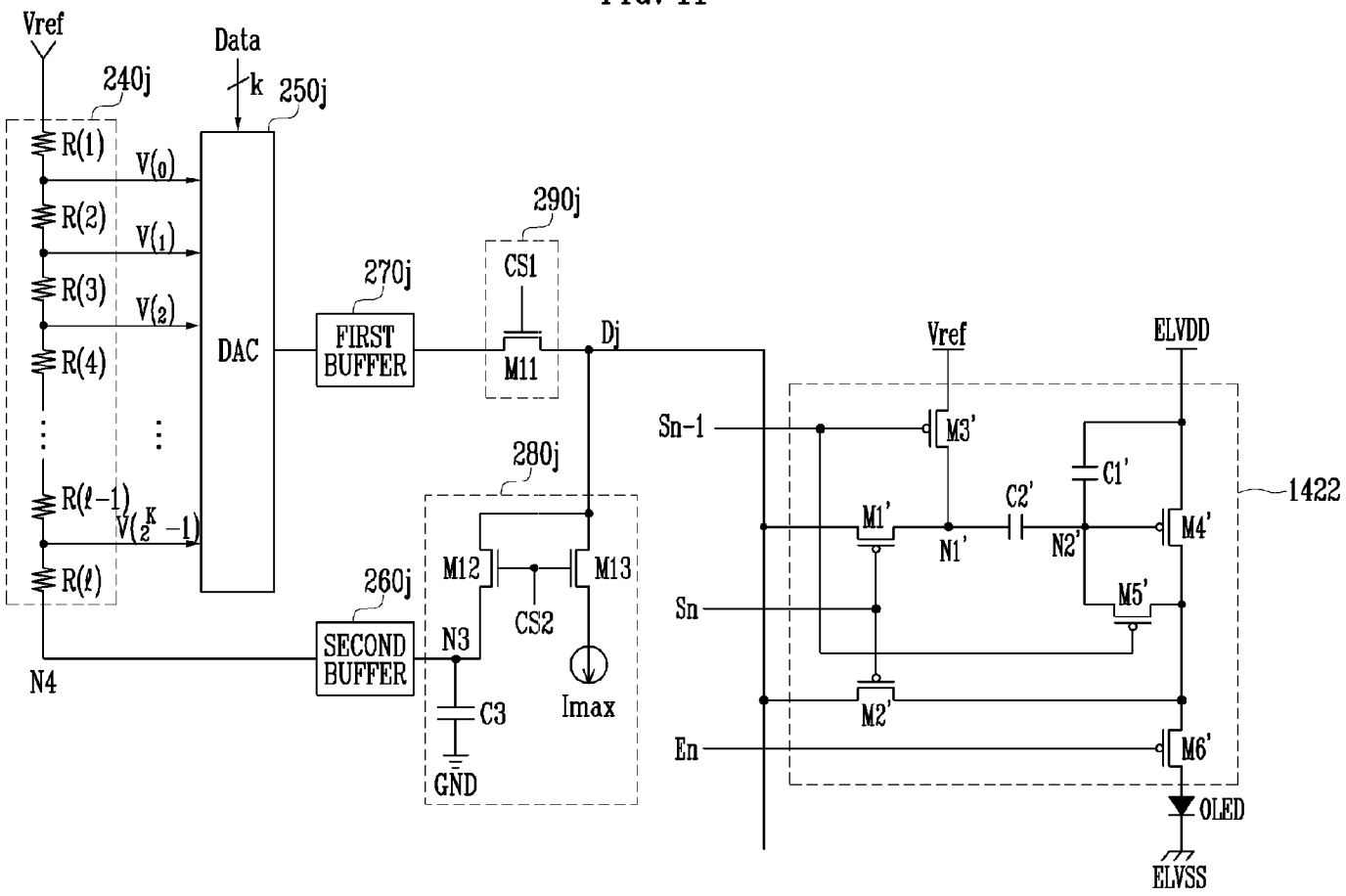
FIG. 11 illustrates another example of the connection among the voltage generator, the digital-to-analog converter, the first buffer, the second buffer, the switching unit, the current sink unit, and the pixel.

FIG. 11 illustrates another example of the connection among the voltage generator, the DAC, the first buffer, the second buffer, the switching unit, the current sink unit, and the pixel provided in the specific channel. The structure of FIG. 11 is the same as the structure of FIG. 8 except that the pixel 1402 is coupled to the data line Dj instead of the first exemplary pixel 1401. Therefore, the voltage supplied to the pixel 1402 will be simply described.

Referring to FIGS. 9 and 11, first, when the scan signal is supplied to the (n−1)th scan line Sn−1, the voltage obtained by EQUATION 1 is applied to the first and second nodes N1' and N2'.

The current that flows through the fourth transistor M4' in the first period when the scan signal is supplied to the nth scan line Sn and the 12$^{th}$ and 13$^{th}$ transistors M12' and M13' are turned on is also represented by EQUATION 2 that pertained to the fourth transistor M4 of the first exemplary pixel circuit 1421 and the voltage applied to the second node N2' in the first period is also represented by EQUATION 3.

The voltage applied to the first node N1' by the coupling of the second capacitor C2' may be represented by EQUATION 9.

$$V_{N1'} = Vref - \left(\frac{C1' + C2'}{C2'}\right)\sqrt{\frac{2Imax}{\mu_p C_{ox}} \frac{L}{W}} = V_{N3'} = V_{N4'} \quad \text{[EQUATION 9]}$$

Since the voltage applied to the first node N1' is also supplied to the third node N3 and the fourth node N4, the voltage $V_{diff}$ across the voltage generator 240*j* may be represented by EQUATION 10.

$$V_{diff} = Vref - \left(Vref - \left(\frac{C1' + C2'}{C2'}\right)\sqrt{\frac{2Imax}{\mu_p C_{OX}} \frac{L}{W}}\right) \quad \text{[EQUATION 10]}$$

When the DAC 250*j* selects the hth gray scale voltage among f gray scale voltages, the voltage Vb supplied to the first buffer 270*j* may be represented by EQUATION 11.

$$Vb = Vref - \frac{h}{f}\left(\frac{C1' + C2'}{C2'}\right)\sqrt{\frac{2Imax}{\mu_p C_{OX}} \frac{L}{W}} \quad \text{[EQUATION 11]}$$

The voltage supplied to the first buffer 270*j* is supplied to the first node N1'. At this time, the voltage applied to the second node N2' may be represented also by EQUATION 7. Therefore, the current that flows through the fourth transistor M4' may be represented by EQUATION 8. That is, according to the present invention, the current supplied to the OLED via the fourth transistor M4' is determined by the gray scale voltage regardless of the threshold voltage and electron mobility of the fourth transistor M4'. Therefore, it is possible to display images with a substantially uniform brightness.

On the other hand, in the pixel 1402 illustrated in FIG. 5, the voltage of the second node N2' gradually changes although the voltage of the first node N1' rapidly changes because it changes proportionally to (C1'+C2')/C2'. Therefore, when the pixel 1402 illustrated in FIG. 5 is used, it is possible to set the voltage range of the voltage generator 240*j* larger than in the case where the pixel 1401 illustrated in FIG. 3 is applied. As described above, when the voltage range of the voltage generator 240*j* is set to be larger, it is possible to reduce the influence of the switching error of the $11^{th}$ transistor M11' and the first transistor M1'.

Figure 12:
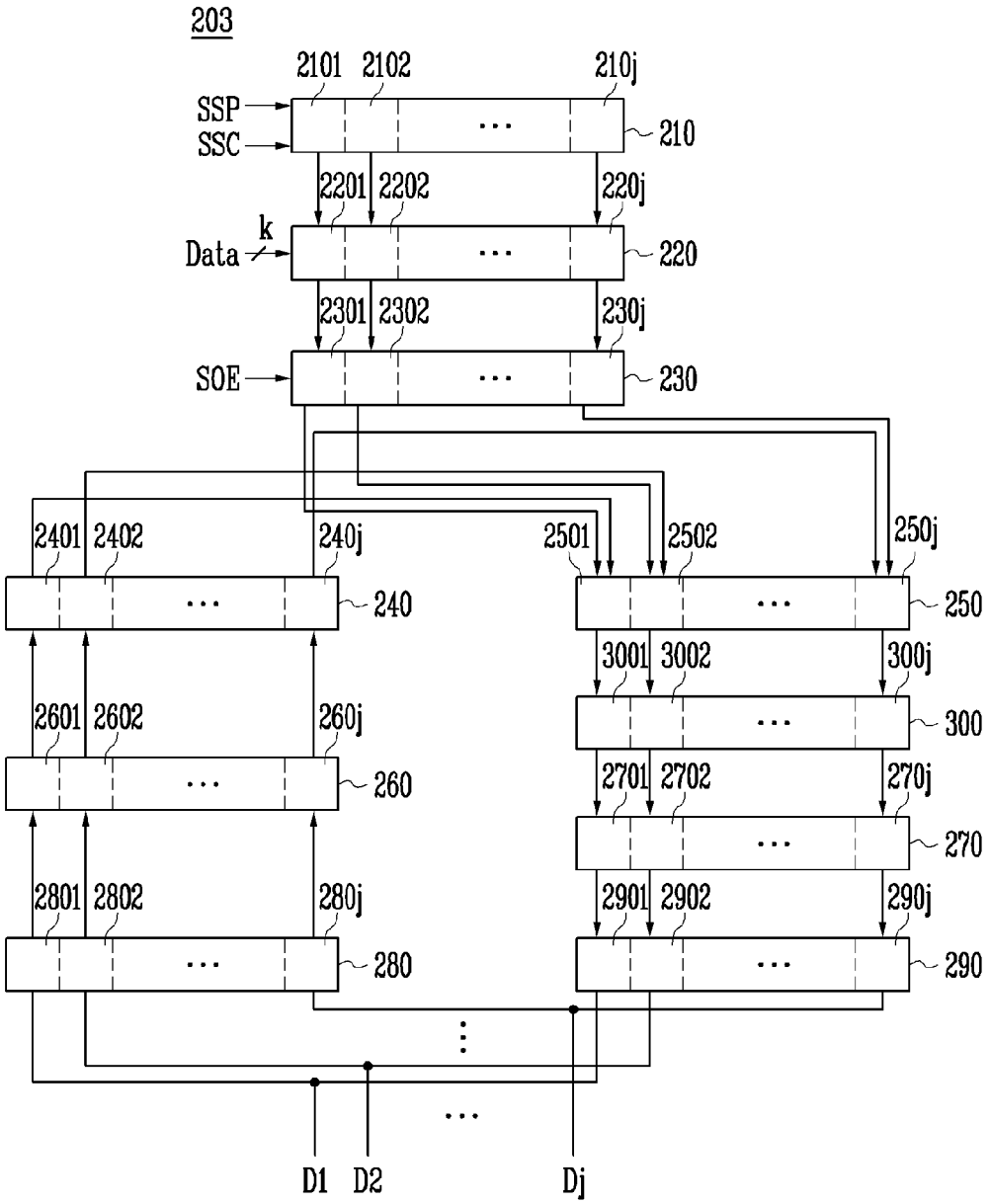
FIG. 12 illustrates still another example of the data driver illustrated in FIG. 2.

FIG. 12 illustrates another example 203 of the data driver 200 illustrated in FIG. 2.

Referring to FIG. 12, the data driver 203 according to another embodiment of the present invention further includes a voltage supply unit 300 provided between the first buffer unit 270 and the DAC unit 250 when compared with the data driver 201 shown in FIG. 6.

Figure 14:
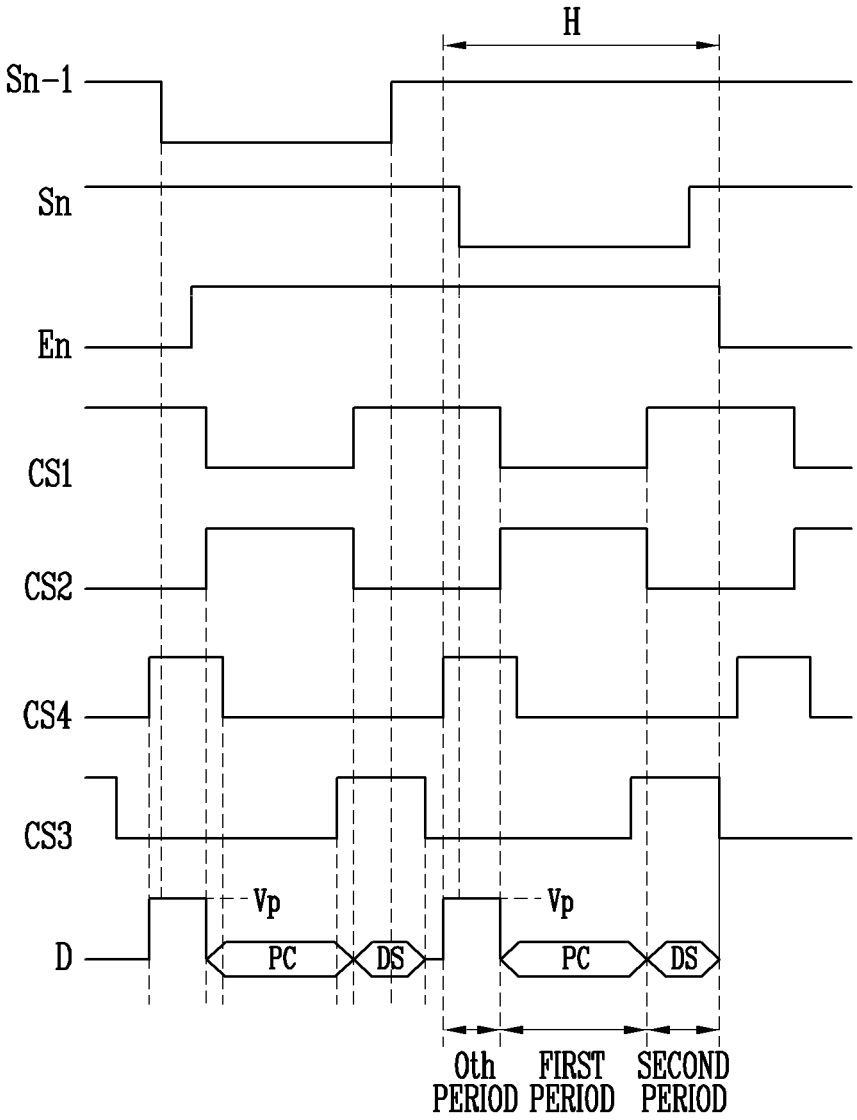
FIG. 14 illustrates waveforms that describe a method of driving the voltage generator, the switching unit, and the current sink unit illustrated in FIG. 13.

The voltage supply unit 300 supplies a precharging voltage Vp to the first buffer unit 270 every horizontal period. Therefore, each horizontal period is divided into a $0^{th}$ period, a first period, and a second period as illustrated in FIG. 14. Here, the voltage supply unit 300 supplies the precharging voltage Vp to the first buffer unit 270 in the $0^{th}$ period of each horizontal period H. That is, the voltage supply unit 300 supplies the precharging voltage before the PC sinks into the current sink Imax. Therefore, it is possible to reduce the time required for sinking the PC.

The voltage supply unit 300 electrically connects the DAC unit 250 and the first buffer unit 270 to each other in the second period of each horizontal period H. Therefore, the voltage supply unit 300 includes j precharging units 3001 to 300*j*.

The first buffer unit 270 supplies the precharging voltage supplied from the precharging units 3001 to 300*j* and the data signals DS supplied from the DAC unit 250 to the switching unit 290*j*.

The selector 290 controls electrical connection between the data lines D1 to Dj and the first buffers 2701 to 270*j*. The selector 290 electrically couples the data lines D1 to Dj and the first buffers 2701 to 270*j* to one another in the $0^{th}$ period in which the precharging voltage Vp is supplied and in the second period in which the data signals DS are supplied and does not connect the data lines D1 to Dj and the first buffers 2701 to 270*j* to each other in the first period.

Figure 13:
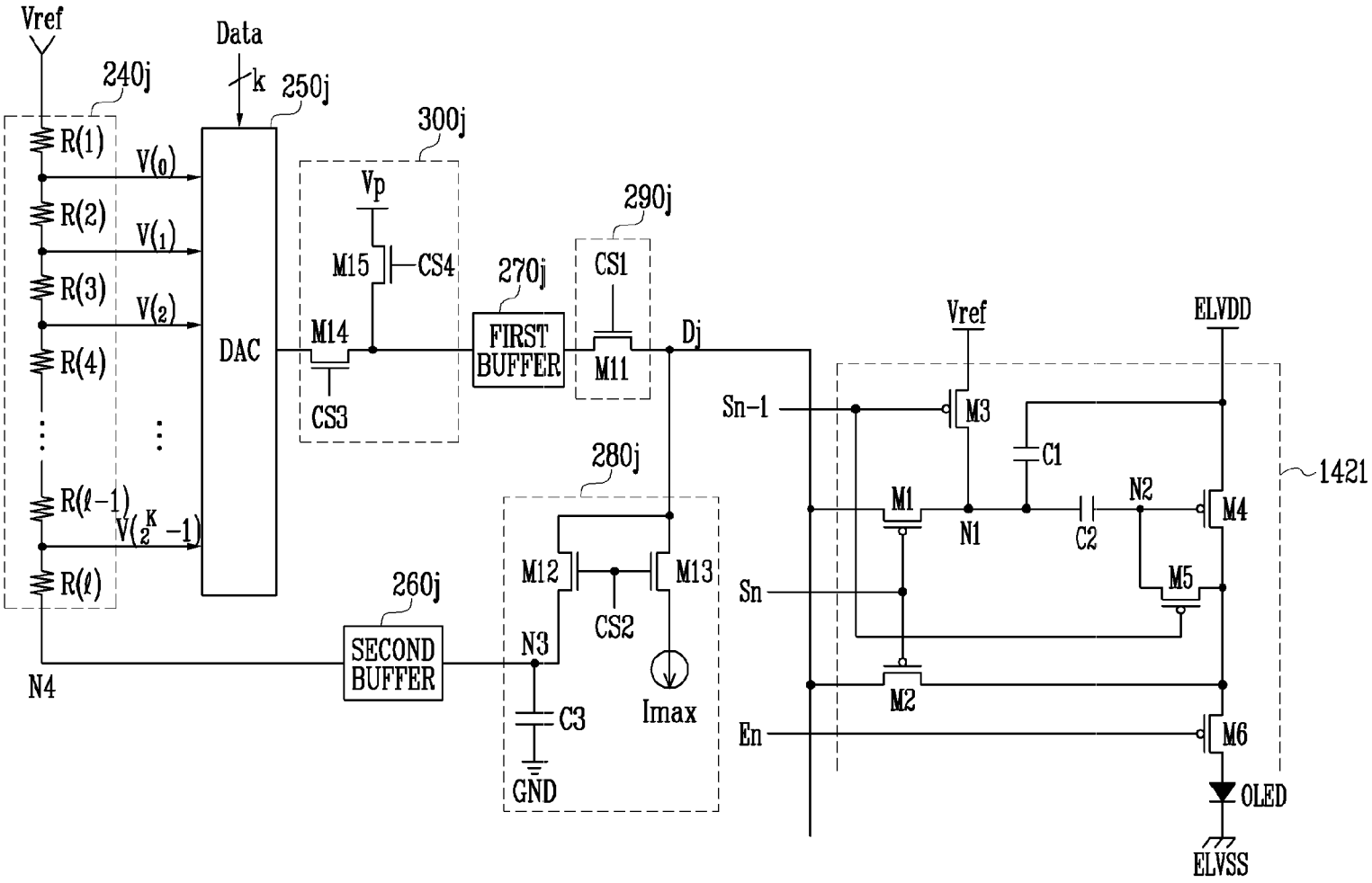
FIG. 13 illustrates the connection among the voltage generator, the digital-to-analog converter, the first buffer, the second buffer, the switching unit, the current sink unit, and the pixel illustrated in FIG. 12.

FIG. 13 illustrates the connection among the voltage generator, the DAC unit, the precharging unit, the first buffer, the second buffer, the switching unit, the current sink unit, and the pixel provided in one specific channel of the data driver illustrated in FIG. 12.

Referring to FIG. 13, the voltage generator 240*j* includes a plurality of voltage dividing resistors R(1) to R(I). The voltage dividing resistors R(1) to R(I) are provided between the reference power source Vref and the second buffer 260*j* to divide a voltage. Actually, the voltage dividing resistors R(1) to R(I) divide the voltage between the voltage of the reference power source Vref and the compensation voltage supplied from the second buffer 260*j* to generate the plurality of gray scale voltages V(0) to $V(2^k-1)$ and to supply the generated gray scale voltages V(0) to $V(2^k-1)$ to the DAC 250*j*.

The DAC 250*j* selects one gray scale voltage among the gray scale voltages V(0) to $V(2^k-1)$ in response to the bit values of the data Data to supply the selected gray scale voltage to the precharging unit 300*j*. Here, the gray scale voltage selected by the DAC 250*j* is used as the data signal DS.

The precharging unit 300*j* includes the $14^{th}$ and $15^{th}$ transistors M14 and M15. The $14^{th}$ transistor M14 is provided between the DAC 250*j* and the first buffer 270*j* to be controlled by a third control signal CS3 illustrated in FIG. 14. The $14^{th}$ transistor M14 is turned on in the second period of the horizontal period H to supply the data signal DS supplied from the DAC 250*j* to the first buffer 270*j*.

The $15^{th}$ transistor M15 is provided between the precharging voltage source Vp and the first buffer 270*j* to be controlled by the fourth control signal CS4. That is, the $15^{th}$ transistor M15 is turned on in the $0^{th}$ period of the horizontal period H to supply the precharging voltage Vp to the first buffer 270*j*.

The first buffer 270*j* transmits the precharging voltage Vp and the data signal DS supplied from the precharging unit 300*j* to the switching unit 290*j*.

The switching unit 290*j* includes the $11^{th}$ transistor M11. The $11^{th}$ transistor M11 is controlled by the first control signal CS1. That is, the $11^{th}$ transistor M11 is turned on in the $0^{th}$ and second periods of the horizontal period H to supply the precharging voltage Vp and the data signal DS to the data line Dj.

The current sink unit 280*j* includes the $12^{th}$ and $13^{th}$ transistors M12 and M13 controlled by the second control signal CS2, the current source Imax coupled to the first electrode of the $13^{th}$ transistor M13, and the third capacitor C3 coupled between the third node N3 and the ground voltage source GND.

The gate electrode of the $12^{th}$ transistor M12 is coupled to the gate electrode of the $13^{th}$ transistor M13. The second electrode of the $12^{th}$ transistor M12 is coupled to the second electrode of the $13^{th}$ transistor M13 and the data line Dj. The first electrode of the $12^{th}$ transistor M12 is coupled to the second buffer 260*j*. The $12^{th}$ transistor M12 is turned on by the second control signal CS2 in the first period of the horizontal period H. The first electrode of the $13^{th}$ transistor M13 is coupled to the current source Imax. The $13^{th}$ transistor M13 is also turned on by the second control signal CS2 in the first period of the horizontal period H.

The current source Imax receives the current to be supplied to the OLED when the pixel 1401 emits light with the maximum brightness in the second period when the $12^{th}$ and $13^{th}$ transistors M12 and M13 are turned on.

The third capacitor C3 stores the compensation voltage applied to the third node N3 when the $12^{th}$ and $13^{th}$ transistors M12 and M13 are on and the current from the pixel 1401 is sunk by the current source Imax that is operating as a current sink.

The third capacitor C3 that has been charged with the compensation voltage, maintains the compensation voltage of the third node N3 uniform even when the $12^{th}$ and $13^{th}$ transistors M12 and M13 are turned off in the second period.

The second buffer 260*j* supplies the compensation voltage applied to the third node N3 to the voltage generator 240*j* at the fourth node N4. The voltage generator 240*j* divides the voltage difference between the voltage of the reference power source Vref and the compensation voltage into a number of different gray scale voltages V(0) to $V(2^k-1)$. The compensation voltage applied to the third node N3 may be the same or may vary in each pixel 1401 due to the mobility of the transistors included in the pixel 1401. The compensation voltages supplied to the j voltage generators 2401 to 240*j* at each point time are determined by the pixels 1401 to which the data lines D1 to Dj are coupled at that point in time.

On the other hand, if different compensation voltages are supplied to the j voltage generators 2401 to 240*j*, the values of the gray scale voltages V(0) to $V(2^k-1)$ supplied to the DACs 2501 to 250*j* provided in the j channels are also different from one another. Since the gray scale voltages V(0) to $V(2^k-1)$ are controlled by the pixels to which the data lines D1 to Dj are currently coupled, although the mobility of the transistors included in the pixels 1401 or 1402 is non-uniform, the display region 130 can display images with a substantially uniform brightness.

FIG. 14 illustrates driving waveforms supplied to the switching unit, the current sink unit, the precharging unit, and the pixel illustrated in FIG. 13.

The voltage value of the data signal DS supplied to the pixel 140 will be described in detail with reference to FIGS. 13 and 14. First, the scan signal is supplied to the (n−1)th scan line Sn−1. When the scan signal is supplied to the (n−1)th scan line Sn−1, the third and fifth transistors M3 and M5 are turned on. Then, the voltage value obtained by subtracting the threshold voltage of the fourth transistor M4 from the first power source ELVDD is applied to the second node N2 and the voltage of the reference power source Vref is applied to the first node N1. At this time, the voltage corresponding to the voltage drop of the first power source ELVDD and the threshold voltage of the fourth transistor M4 are charged in the second capacitor C2.

The voltages applied to the first node N1 and the second node N2 may be represented by EQUATION 1. However, in a period between the point of time where the scan signal supplied to the (n−1)th scan line Sn−1 is turned off and the point of time where the scan signal is supplied to the nth scan line Sn, the first and second nodes N1 and N2 float. Therefore, the value of the voltage charged in the second capacitor C2 does not change.

Then, the scan signal is supplied to the nth scan line Sn so that the first and second transistors M1 and M2 are turned on. In the portion of the $0^{th}$ period when the scan signal is supplied to the nth scan line Sn, the $15^{th}$ and $11^{th}$ transistors M15 and M11 are also turned on by their respective control signals CS4 and CS1. When the $15^{th}$ and $11^{th}$ transistors M15 and M11 are turned on, the precharging voltage Vp is supplied to the first node N1 via the $15^{th}$ transistor M15, the first buffer 270*j*, the $11^{th}$ transistor M11, the data line Dj, and the first transistor M1. As a result, the voltage corresponding to the precharging voltage Vp is charged in the first capacitor C1.

Here, the value of the precharging voltage Vp is determined to correspond to the value of the current source Imax. The value of the precharging voltage Vp is set so that a current corresponding to the current source Imax can flow through the fourth transistor M4. That is, the value of the precharging voltage Vp is set so that the current obtained when the pixel 1401 emits light with the maximum brightness flows through the fourth transistor M4.

Then, the $12^{th}$ and $13^{th}$ transistors M12 and M13 are turned on in the first period of the horizontal period H by their common control signal CS2. When the $12^{th}$ and $13^{th}$ transistors M12 and M13 are turned on, the current that flows through the current source Imax via the first power source ELVDD, the fourth transistor M4, the second transistor M2, the data line Dj, and the $13^{th}$ transistor M13 sinks into this current source.

At this time, the current of the current source Imax through the fourth transistor M4, is obtained by EQUATION 2. The voltage applied to the second node N2 when the current obtained by EQUATION 2 flows through the fourth transistor M4 may be represented by EQUATION 3.

The voltage applied to the first node N1 by the coupling of the second capacitor C2 may be represented by EQUATION 4.

The voltage $V_{N1}$ applied to the first node N1 is ideally the same as the voltage $V_{N3}$ applied to the third node N3 and the voltage $V_{N4}$ applied to the fourth node N4. That is, when the current is sunk by the current source Imax, the voltage obtained by EQUATION 4 is applied to the fourth node N4. On the other hand, since a predetermined voltage is charged in the first capacitor C1 by the precharging voltage Vp in the $0^{th}$ period, it is possible to minimize the length of time for which the voltage obtained by EQUATION 4 is applied to the fourth node N4.

As illustrated in EQUATION 4, the voltage applied to the third and fourth nodes N3 and N4 is affected by the electron mobility of the transistors included in the pixel 140 the current from which sinks. Therefore, the voltage value applied to the third and fourth nodes N3 and N4 when the current is sunk by the current source Imax varies in each of the pixels 140 (or 1401 or 1402).

On the other hand, when the voltage obtained by EQUATION 4 is applied to the fourth node N4, the voltage $V_{diff}$ across the voltage generator 240*j* may be represented by EQUATION 5.

When the DAC 250*j* selects the hth (h is a natural number no more than f) gray scale voltage among f (f is a natural number) gray scale voltages in response to the data Data, the voltage Vb supplied to the first buffer 270*j* may be represented by EQUATION 6.

However, after the current sinks in the first period so that the voltage obtained by EQUATION 4 is charged in the third capacitor C3, the $12^{th}$ and $13^{th}$ transistors M12 and M13 are turned off and the $14^{th}$ and $11^{th}$ transistors M14 and M11 are turned on in the second period. At this time, the third capacitor C3 maintains the voltage charged in the capacitor. Therefore, the voltage value of the third node N3 may be maintained as illustrated in EQUATION 4.

Since the $14^{th}$ and $11^{th}$ transistors M14 and M11 are turned on in the second period of the horizontal period H, the data signal selected by the DAC 250*j* is supplied to the first node N1 via the first buffer 270*j*, the data line Dj, and the first transistor M1. That is, the voltage obtained by EQUATION 6 is supplied to the first node N1. The voltage applied to the second node N2 by the coupling of the second capacitor C2 may be represented by EQUATION 7.

At this time, the current that flows via the fourth transistor M4 may be represented by EQUATION 8.

Referring to EQUATION 8, according to the present invention, the current that flows through the fourth transistor M4 is determined by the gray scale voltage generated by the voltage generator 240*j*. That is, according to the present invention, the current determined by the gray scale voltage can flow to the fourth transistor M4 regardless of the threshold voltage and electron mobility of the fourth transistor M4. Therefore, it is possible to display images with a substantially uniform brightness. Also, according to the present invention, since the precharging voltage Vp is supplied to the pixel 140 (or pixel 1401 or pixel 1402) in the $0^{th}$ period, it is possible to reduce the driving time of the first period in which the current sinks.

As described above, according to the data driver of the embodiments of the present invention, the organic light emitting display device using the data driver, and the method of driving the organic light emitting display device, since the values of the gray scale voltages generated by the voltage generator are reset using the compensation voltage generated when the current from the pixel sinks and the reset gray scale voltages are supplied to the pixel the current from which sinks, it is possible to display images with a substantially uniform brightness regardless of the electron mobility of the transistors. According to the present invention, since the precharging voltage is supplied before the currents sink, it is possible to reduce the time for which the currents sink and to stably drive the organic light emitting display device.

Although certain exemplary embodiments of the present invention have been shown and described, it would be appreciated by those skilled in the art that changes might be made to these embodiments without departing from the principles and spirit of the invention, the scope of which is defined in the claims and their equivalents.

What is claimed is:

1. An organic light emitting display device comprising:

a display region including a plurality of pixels coupled to scan lines, data lines, and emission control lines;

a scan driver for supplying scan signals to the scan lines and for supplying emission control signals to the emission control lines; and at least one data driver for supplying predetermined currents to the data lines in a first period of each horizontal period to generate compensation voltages, for resetting values of gray scale voltages with reset values using the compensation voltages, and for generating data signals using the reset values of the gray scale voltages, wherein a pixel from among the pixels is coupled to a current scan line and a previous scan line among the scan lines and a data line among the data lines, and the pixel comprises:

a first power source;

an organic light emitting diode for receiving a pixel current from the first power source;

a first transistor and a second transistor each having a first electrode coupled to the data line and turned on when one of the scan signals is supplied to the current scan line;

a third transistor coupled between a second electrode of the first transistor and a reference power source and turned on when another one of the scan signals is supplied to the previous scan line;

a fourth transistor for controlling the pixel current received by the organic light emitting diode having a first electrode coupled to the first power source; and a fifth transistor coupled between a gate electrode and a second electrode of the fourth transistor and turned on when said another one of the scan signals is supplied to the previous scan line, when turned on, the fifth transistor conducting current to the fourth transistor so that the fourth transistor operates as a diode, and wherein the data driver comprises:

a plurality of current sink units receiving the predetermined currents from the pixels in the first period of each horizontal period;

a plurality of voltage generators for resetting the values of the gray scale voltages using the compensation voltages generated when the predetermined currents flow;

a plurality of digital-to-analog converters for selecting one gray scale voltage among the gray scale voltages as a data signal in response to bit values of data supplied from an outside; and a plurality of switching units for supplying the data signals to the data lines in a second period excluding the first period of each horizontal period.

2. The organic light emitting display device as claimed in claim 1, wherein the pixel further comprises:

a first capacitor coupled between the second electrode of the first transistor and the first power source; and a second capacitor coupled between the second electrode of the first transistor and a gate electrode of the fourth transistor.

3. The organic light emitting display device as claimed in claim 1, wherein the pixel further comprises:

a first capacitor coupled between a gate electrode of the fourth transistor and the first power source; and a second capacitor coupled between the second electrode of the first transistor and the gate electrode of the fourth transistor.

4. The organic light emitting display device as claimed in claim 1, wherein the pixel further comprises a sixth transistor coupled between the second electrode of the fourth transistor and the organic light emitting diode, the sixth transistor being turned off when a respective one of the emission control signals is supplied, and turned on otherwise.

5. The organic light emitting display device as claimed in claim 1, wherein each of the current sink units receives a maximum current that can be supplied by the pixel to the organic light emitting diode.

6. The organic light emitting display device as claimed in claim 1, wherein each of the current sink units comprises:

a current source for receiving the predetermined currents;

a sixth transistor located between the data line and one of the voltage generators to be turned on in the first period;

a seventh transistor located between the data line and the current source to be turned on in the first period; and a capacitor for being charged with one of the compensation voltages applied to the sixth transistor when one of the predetermined currents flows through the data line.

7. The organic light emitting display device as claimed in claim 1, wherein each of the switching units comprises at least one transistor being turned on in the second period.

8. The organic light emitting display device as claimed in claim 7, wherein each of the switching units comprises two transistors, and wherein the two transistors are coupled to each other in a form of a transmission gate.

9. The organic light emitting display device as claimed in claim 1, wherein each of the voltage generators comprises a plurality of voltage dividing resistors coupled between a first terminal and a second terminal in order to generate the gray scale voltages.

10. The organic light emitting display device as claimed in claim 9, wherein the first terminal receives a reference power, and wherein the second terminal receives one of the compensation voltages.

11. The data driver as claimed in claim 1, further comprising:

first buffers located between the digital-to-analog converters and the switching units; and second buffers located between the current sink units and the voltage generators.

12. The organic light emitting display device as claimed in claim 1, further comprising at least one precharging unit for supplying precharging voltages to pixels coupled to the data lines in a $0^{th}$ period before the first period.

* * * * *